US009586077B2

(12) United States Patent
Kabasso

(10) Patent No.: US 9,586,077 B2
(45) Date of Patent: Mar. 7, 2017

(54) BED EXERCISE APPARATUS

(71) Applicant: David Kabasso, Brooklyn, NY (US)

(72) Inventor: David Kabasso, Brooklyn, NY (US)

( * ) Notice: Subject to any disclaimer, the term of this patent is extended or adjusted under 35 U.S.C. 154(b) by 162 days.

(21) Appl. No.: 14/343,442

(22) PCT Filed: Sep. 24, 2012

(86) PCT No.: PCT/US2012/056966
§ 371 (c)(1),
(2) Date: Mar. 7, 2014

(87) PCT Pub. No.: WO2013/052302
PCT Pub. Date: Jul. 11, 2013

(65) Prior Publication Data

US 2014/0200125 A1 Jul. 17, 2014

Related U.S. Application Data

(60) Provisional application No. 61/543,920, filed on Oct. 6, 2011.

(51) Int. Cl.

| | |
|---|---|
| ***A63B 21/00*** | (2006.01) |
| ***A63B 23/035*** | (2006.01) |
| ***A47C 19/22*** | (2006.01) |
| *A63B 21/04* | (2006.01) |
| *A63B 21/055* | (2006.01) |

(52) U.S. Cl.
CPC ..... *A63B 21/00083* (2013.01); *A47C 19/22* (2013.01); *A63B 21/00185* (2013.01); *A63B 21/1672* (2015.10); *A63B 21/4027* (2015.10); *A63B 23/03575* (2013.01); *A63B 21/0442* (2013.01); *A63B 21/0552* (2013.01); *A63B 21/4035* (2015.10); *A63B 2210/04* (2013.01)

(58) Field of Classification Search
CPC ..... A63B 21/00
USPC ..... 482/904, 142, 130
See application file for complete search history.

(56) References Cited

U.S. PATENT DOCUMENTS

| | | | | |
|---|---|---|---|---|
| 1,240,809 | A | 9/1917 | Baldwin | |
| 1,561,979 | A | 5/1925 | Gore | |
| 2,057,811 | A * | 10/1936 | Armstrong | 5/662 |
| 2,245,331 | A | 6/1941 | Dawley | |
| 3,077,613 | A | 2/1963 | Mayer | |
| 3,134,592 | A | 5/1964 | Sharkey | |
| 3,218,067 | A | 11/1965 | Beverly | |
| 3,699,953 | A | 10/1972 | Masson | |
| 3,826,490 | A * | 7/1974 | Mossman | 482/94 |
| 3,887,180 | A | 6/1975 | Berman | |

(Continued)

FOREIGN PATENT DOCUMENTS

| | | | |
|---|---|---|---|
| CH | 675971 | A5 | 11/1990 |
| DE | 2145884 | A1 | 3/1973 |

(Continued)

*Primary Examiner* — Jerome W Donnelly
(74) *Attorney, Agent, or Firm* — Law Office of M. Zev Levoritz; Menachem Zev Levoritz

(57) ABSTRACT

An exercise apparatus that may be used in a bed, primarily for stretching and resistance exercises. The exercise apparatus may be configured with a lower frame and an upper frame. The lower frame is disposed between and connected to a bed frame and a headboard. The upper frame is connected to the lower frame and has exercise equipment attachment couplers.

27 Claims, 18 Drawing Sheets

(56) References Cited

U.S. PATENT DOCUMENTS

| | | | | |
|---|---|---|---|---|
| 4,591,121 | A | 5/1986 | Doyle | |
| 4,611,804 | A | 9/1986 | Addair | |
| 4,635,931 | A | 1/1987 | Brännstam | |
| 4,671,257 | A | 6/1987 | Kaiser et al. | |
| 4,672,697 | A | 6/1987 | Schürch | |
| 4,717,148 | A | 1/1988 | Brewer | |
| 4,829,610 | A | 5/1989 | Gonzalez-Alvarez et al. | |
| 4,905,330 | A | 3/1990 | Jacobs | |
| 4,925,184 | A | 5/1990 | McJunkin, Jr. et al. | |
| 5,005,829 | A | 4/1991 | Caruso | |
| 5,160,306 | A | 11/1992 | Lui | |
| 5,181,289 | A | 1/1993 | Kassai | |
| 5,207,628 | A | 5/1993 | Graham | |
| 5,375,280 | A | 12/1994 | O'Sullivan et al. | |
| 5,407,411 | A | 4/1995 | Trainor | |
| 5,743,050 | A | 4/1998 | Shibata | |
| 5,820,519 | A | 10/1998 | Slenker | |
| 5,820,532 | A | 10/1998 | Oliver | |
| 5,989,168 | A | 11/1999 | See | |
| 6,152,855 | A | 11/2000 | Dean, Jr. et al. | |
| 6,228,004 | B1 * | 5/2001 | Steinbach et al. | 482/121 |
| 6,241,642 | B1 | 6/2001 | Slenker | |
| 6,685,605 | B1 | 2/2004 | Klossner | |
| 7,229,392 | B2 * | 6/2007 | Turnbull et al. | 482/129 |
| 2003/0224915 | A1 | 12/2003 | Charoenchit | |
| 2004/0157708 | A1 | 8/2004 | Matthews | |
| 2005/0272566 | A1 | 12/2005 | Otsuka | |
| 2007/0203434 | A1 | 8/2007 | Namgung et al. | |
| 2008/0254954 | A1 | 10/2008 | Kim | |

FOREIGN PATENT DOCUMENTS

| | | | |
|---|---|---|---|
| EP | 0514368 | A1 | 12/1999 |
| JP | 11276306 | A | 12/1999 |
| JP | 2002065892 | A | 3/2002 |
| JP | 2007296224 | A | 11/2007 |
| KR | 100346528 | B1 | 7/2002 |

* cited by examiner

BED EXERCISE APPARATUS

TECHNICAL FIELD

The invention disclosed herein generally relates to an exercise apparatus. In particular, the inventive exercise apparatus is primarily for exercising in a bed mainly for stretching and resistance exercises.

BACKGROUND ART

Exercise and strengthening of muscles is very important to the maintenance of health. Many people who are sick and bedridden or generally more sedentary lose muscle tone, which leads into a cycle of further loss of muscle strength. Even people who are not bedridden or sedentary often require regular exercise therapy to strengthen muscles to address ongoing maladies such as back pain. Sometimes it is necessary for people to perform exercises first thing in the morning right after waking up and even before getting out of bed to allow them to become mobile. Furthermore, many people are unable or do not have the time to go to a gym and are more likely to have the time to exercise and would prefer to exercise at home.

Home exercise equipment, however, poses many issues. Very often people do not have the space in their abode to accommodate the exercise equipment. In order to address this issue, equipment often is folded away in some manner to be put out of sight under a bed or in a closet or to stand unobtrusively against a wall. However, this equipment is not easily brought out and set up by someone who is sick and bedridden or has very low muscle tone. Moreover, the unobtrusiveness of the equipment is also not conducive to encouraging regular use.

In order to address this issue, others have devised exercise equipment to be used in a bed. Very often, due to the type of exercise that the equipment needs to provide, the exercise equipment must be braced in some manner against the bed structure. For example, U.S. Pat. No. 5,820,519 and U.S. Pat. No. 5,820,532 disclose exercise equipment that is clamped to the upper portion of a headboard or is braced with some kind of horizontal member or board extending under the mattress. However, equipment that is clamped against the upper portion of a headboard may cause damage to the headboard. Moreover, it puts a high torque force on the upper part of the headboard or footboard when used, and thereby applies excessive force to the attachments of the headboard or footboard. This type of equipment is also usually very unsightly, and is difficult to repeatedly remove and attach. Equipment that is braced under the mattress applies a force to the mattress or box-spring below the mattress that it is not designed to withstand. Furthermore, the horizontal member or board will push up on the mattress and make the mattress lumpy and uneven to sleep on. It is also difficult to install and remove the horizontal member, because a person must lift up the mattress to do so. Also, if left in place, this type of exercise equipment is unsightly as well. Others, such as U.S. Pat. No. 1,561,979 and U.S. Pat. No. 3,218,067, show headboards and/or footboards with built-in exercise equipment. However, such headboards and footboards with built-in exercise equipment can be bulky, very expensive, and are not easily reconfigurable.

DISCLOSURE OF INVENTION

This application claims priority to co-pending U.S. Provisional Patent Application No. 61/543,920 by Kabasso, entitled "Bed Exercise Apparatus", filed Oct. 6, 2011, and is hereby incorporated by reference into the current application for all purposes.

The present invention provides an exercise apparatus that may be used in a bed and be easily configured for many different exercises, primarily stretching and resistance exercises, while minimizing stress on the bed structure and in some embodiments may be dismantled and/or hidden from view with relative ease.

In one exemplary embodiment, the exercise apparatus has a lower frame and an upper frame. The lower frame can be positioned between a headboard and a bed frame. The headboard mattress-facing side may be connected to the lower frame. Similarly, the bed frame headboard-facing side may be connected to the lower frame. The lower frame preferably does not extend above a top surface of a mattress on the bed frame. The lower frame may have one or more attachment couplers connected to it. The attachment couplers preferably extend and/or are capable of extending above the top surface of the mattress and one or more exercise bands may attach to the attachment couplers. The upper frame is configured to be connected on a top of the lower frame and may serve as an intermediate connection between some or all of the attachment couplers and the lower frame. This exemplary embodiment of the exercise apparatus may also include one or more poles that connect to the exercise apparatus via a set of one or more apertures in the lower frame or upper frame.

In one exemplary embodiment, the exercise apparatus includes a bed frame, a headboard, a lower frame and an upper frame. A head of the bed frame connects to a front wide side of the lower frame. On a back wide side of the lower frame a front wide side of the headboard is connected. The upper frame has attachment couplers, also referred to as equipment mounting connections, for exercise equipment and is configured to connect to the lower frame in such manner that at least a portion of the upper frame may be disposed above an upper side of the lower frame. The upper frame may be configured with an upper crossbeam and a lower crossbeam and one or more mounting bars, which act as attachment couplers for exercise equipment, extending from the upper crossbeam to the lower crossbeam.

In one exemplary embodiment, the exercise apparatus includes a lower frame and an upper frame for a bed with a bed frame and a headboard. The head board is positioned by a head of the bed frame with the lower frame positioned between the head of the bed frame and the headboard. The lower frame may be fixedly connected to the bed frame and/or headboard. The upper frame has attachment couplers for exercise equipment and is configured to connect to the lower frame in such manner that at least a portion of the upper frame may be disposed above an upper side of the lower frame. The bed may further include a mattress and the lower frame may be configured in such manner that the upper side of the lower frame does not extend above a top surface level of the mattress. The upper side of the upper frame preferably extends above a top surface level of the mattress. The upper frame may be configured with an upper crossbeam and a lower crossbeam and one or more mounting bars extending from the upper crossbeam to the lower crossbeam. The exercise apparatus may further include one or more exercise bands connected to the one or more mounting bars.

In one alternative configuration, the exercise apparatus may include: a lower section ring, a lower sheave, an upper sheave, and an elongated exercise band. The lower section ring and the lower sheave are mounted proximate to an upper surface of a lower crossbeam of the upper frame. The upper sheave is mounted proximate to an upper surface of an upper crossbeam of the upper frame. The elongated exercise band is mounted at a first end to the lower section ring. The elongated exercise band extends from the first end of the exercise band around the lower sheave and then around the upper sheave. Band guide apertures in an upper crossbeam of the upper frame allow the elongated exercise band to extend therethrough between the lower sheave and the upper sheave. The upper frame may also have a bisecting crossbeam that bisects the upper frame into an upper portion and a lower portion. Extending between the bisecting crossbeam and the upper crossbeam may be one or more mounting bars. The bisecting crossbeam may also have second band guide apertures that allow the exercise band to extend through the bisecting crossbeam.

In embodiments of the exercise apparatus according to the present invention that have a lower and upper frame, the upper frame may be removably connected to the lower frame. In one such exemplary configuration, the upper frame has a mounting elbow connected to a lower surface of a lower crossbeam of the upper frame proximal to a first narrow side of the upper frame and a mounting bracket on a second narrow side. In this configuration, the upper frame may be mounted on the lower frame by first positioning the lower surface of the lower crossbeam of the upper frame perpendicular to the upper surface of the upper crossbeam of the lower frame, then inserting the mounting elbow into the mounting aperture, then rotating the upper frame so as to bring the lower surface of the lower crossbeam of the upper frame into flush contact with the upper surface of the upper crossbeam of the lower frame, and then anchoring the mounting bracket to a second narrow side of the lower frame. Alternatively, the upper frame and lower frame may be configured with a tongue and groove type connection which allows for removable connection of the upper frame by sliding a tongue portion on one of the frames in or out of a groove on the other frame. Where the upper frame is removable from the lower frame, the upper surface of the lower frame may be a padding material layer.

The exercise apparatus according to the present invention may include a rod that connects to the upper frame, the lower frame or both. The rod may be connected via a set of rod apertures in the upper frame, the lower frame or both. In one alternative configuration, the upper frame has an upper frame upper crossbeam and an upper frame lower crossbeam and the set of rod apertures includes a first rod aperture in a top surface of the upper frame upper crossbeam, the rod extending through the set of rod apertures. The set of rod apertures may further include an aperture in a lower surface of the upper frame upper crossbeam. The set of rod apertures may further include an aperture in an upper surface of the upper frame lower crossbeam. The set of rod apertures may further include an aperture in a lower surface of the upper frame lower crossbeam. The lower frame may also be configured with a lower frame upper crossbeam and a lower frame lower crossbeam and the set of rod apertures further includes an aperture in an upper surface of the lower frame upper crossbeam. The set of rod apertures may further include an aperture in a lower surface of the lower frame upper crossbeam. The set of rod apertures may further include an aperture in an upper surface of the lower frame lower crossbeam. The set of rod apertures may further include an aperture in a lower surface of the lower frame lower crossbeam. The rod may be height adjustable. In one exemplary embodiment the rod is height adjustable by configuring the rod with rod protrusions and configuring the apertures with an irregular shape. The rod protrusions allow the rod to slide through the apertures only when they are aligned with the irregular shape of the rod apertures. Alternatively, the rod may be configured with several nested portions that can extend or retract.

The rod may be configured with a mounting ring; the mounting ring may be positioned at a top of the rod. The exercise apparatus may further include one or more exercise bands connected to the mounting ring. Alternatively, the rod may have a top sheave mounted proximal to the top of the rod and a bottom sheave mounted to the rod below the top sheave with the mounting ring positioned along a side of the rod. In this exemplary configuration, the exercise apparatus may include an exercise band that connects at a first end to the mounting ring and extends over a top of the sheave then extends to the bottom sheave, and then under the bottom sheave and over the head of the bed frame. The exercise band may have a handle on a second end distal to the first end. In another alternative exemplary configuration, a desk is rotatably mounted on the rod. In a further alternative exemplary configuration, a lamp is rotatably or fixedly mounted on the rod.

The exercise apparatus according to the present invention may have a lower frame and/or upper frame that are configured in a rectangular annular shape. The lower frame and/or upper frame of the exercise apparatus according to the present invention may be formed of hollow tubing and/or have a rectangular cross-sectional form.

In one alternative configuration of the exercise apparatus according to the present invention, the bed frame has a bed frame middle crossbeam that extends from a first wide side of the bed frame to an opposing second wide side. The lower frame, in this configuration may have a bracing bar that connects to the bed frame middle crossbeam.

The exercise apparatus according to the present invention may have a lower frame mounting ring connected to the lower frame. The lower frame mounting ring may be mounted on a lower surface of the lower crossbeam of the lower frame. Similarly, an upper frame mounting ring may be provided on the upper frame and it may be mounted on the upper surface of the upper crossbeam of the upper frame. Alternatively, a hinge may be mounted to the upper surface of the upper frame. A rod is rotatably mounted to the hinge on a first end and the upper frame mounting ring is provided on a second end of the rod. The rod is preferably capable of at least rotating in such manner that a top of the rod may be moved from being proximate to a first narrow side of the upper frame to being proximate to a second narrow side of the upper frame.

In an exercise apparatus configuration with the lower frame mounting ring, the exercise apparatus may further include an exercise band that extends to a distal end of the bed frame opposing the head of the bed frame. Alternatively, the exercise apparatus may also include a side pole mounted on a side of the bed frame other than the head of the bed frame. On the side pole is an upper sheave mounted on the side pole proximal to an upper end of the side pole and a lower sheave mounted on the side pole proximal to a lower end of the side pole. The exercise band mounted to the lower frame mounting ring then extends first through the lower sheave, and then through the upper sheave.

In one alternative exemplary configuration of the exercise apparatus according to the present invention the upper frame is movably connected to the lower frame. The lower frame has a lower beam, a first side beam and a second side beam. The first and second side beams extend from the lower beam on opposing narrow sides of the lower beam forming an open upper side between them. Along inner sides of the first and second side beams are slide tracks that form a restricted guide way. The upper frame is positioned in the slide tracks so that it can slide along the restricted guide way and through the open upper side of the lower frame. The restricted guide way also provides for fixedly positioning the upper frame at one or more positions.

In this exemplary configuration, where the upper frame is movably connected to the lower frame, the exercise apparatus may also include a first upper sprocket, a first lower sprocket, a roller chain and a control system. The first upper sprocket is positioned above the first lower sprocket in or by a first one of the slide tracks and the roller chain mounted on the first upper sprocket and the first lower sprocket traverses a portion or the entire first one of the slide tracks. The upper frame has teeth that mesh with the roller chain so that the upper frame may move in tandem with the roller chain. The control system connects to the first upper sprocket and/or the first lower sprocket and drives or controls the sprockets. The control system may include a user controllable motor, a manual crank or other similar mechanism to drive the sprockets and/or a brake, a flywheel or other similar mechanism to restrict sprocket rotation.

Additionally, in this exemplary configuration of the exercise apparatus with the roller chain, the exercise apparatus may also include a second upper sprocket mounted above a second lower sprocket in or by a second one of the slide tracks. The roller chain may be mounted on the second upper sprocket and the second lower sprocket as well in such manner that the roller chain traverses the second one of the slide tracks in the same direction or a second roller chain may be mounted in the second one of the slide tracks. Although, preferable, in the configurations with the roller chain, the exercise apparatus does not require the slide tracks to form a restricted guide way.

Alternatively, in this exemplary configuration where the upper frame is movably connected to the lower frame, the exercise apparatus may also include a detent and a detent control. A first one of the slide tracks on the lower frame has one or more latching notches. The detent is located on the upper frame so that it can extend into the one or more latching notches to lock the upper frame into one of the one or more positions. The detent control allows for user control over the extension and retraction of the detent. The exercise apparatus may also have one or more latching notches on a second one of the slide tracks on the lower frame, preferably corresponding to the latching notches on the first one of the sliding tracks. A corresponding second detent that can extend into the one or more latching notches on the second one of the slide tracks is provided on the upper frame along with a second detent control that controls the extension and retraction of the second detent.

In another exemplary embodiment of an exercise apparatus according to the present invention, the exercise apparatus includes a lower frame and an upper frame. The lower frame has a lower beam with a first side beam and a second side beam that are provided on opposing narrow sides of the lower beam. The first and second side beams are configured as telescoping beams with nested beam portions that can extend and retract. The upper frame is mounted on the side beams in such manner that the upper frame may be raised and lowered by the first and second side beams extending and retracting. The exercise apparatus may further include a hydraulic pump fluidly connected to one or both of the side beams to control the raising and lowering of the upper frame and a switch to control the hydraulic pump.

In another exemplary embodiment of the present invention, the exercise apparatus includes a lower frame and a rod for a bed with a bed frame and a headboard positioned by a head of the bed frame. The lower frame is positioned between the bed frame and the headboard. The rod connects to the lower frame in such manner that at least a portion of the rod may be disposed above an upper side of the lower frame.

In another exemplary embodiment of the present invention, the exercise apparatus includes a bed frame, a headboard, a lower frame and an upper frame. The lower frame is disposed between the bed frame and headboard. The lower frame may be connected to the bed frame and headboard. The upper frame is connected to the lower frame and has exercise equipment mounting connections.

BRIEF DESCRIPTION OF DRAWINGS

FIG. 1(*b*) is a cross sectional view along line 1(*b*)-1(*b*)' of the first exemplary embodiment of an exercise apparatus according to the present invention;

FIG. 1(*c*) is a cross sectional view along line 1(*c*)-1(*c*)' of the first exemplary embodiment of an exercise apparatus according to the present invention;

FIG. 1(*d*) is a top view of an exemplary rod aperture for an exemplary adjustable height rod for a bed exercise apparatus according to the present invention;

FIG. 1(*e*) is a perspective view of the exemplary adjustable height rod for a bed exercise apparatus according to the present invention;

FIG. 3(*b*) is a side view of the first exemplary embodiment of the bed exercise apparatus connected to the bed frame and headboard with exemplary equipment attachments and with the box spring and mattress according to the present invention;

FIG. 3(*c*) is a side view of the first exemplary embodiment of the bed exercise apparatus connected to the bed frame and headboard with exemplary equipment attachments and with the box spring and mattress according to the present invention;

FIG. 3(*d*) is a side view of the first exemplary embodiment of the bed exercise apparatus connected to the bed frame and headboard with exemplary equipment attachments and with the box spring, mattress and a mattress extender in a closed position according to the present invention;

FIG. 3(*e*) is a side view of the first exemplary embodiment of the bed exercise apparatus connected to the bed frame and headboard with exemplary equipment attachments and with the box spring, mattress and the mattress extender in an open position according to the present invention;

FIG. 7(*b*) is a first narrow side view of a fourth exemplary embodiment of the bed exercise apparatus according to the present invention;

FIG. 8(*b*) is a top view of the fifth exemplary embodiment of the bed exercise apparatus according to the present invention;

FIG. 8(*c*) is a front wide side view of a first alternative configuration for the fifth exemplary embodiment of the bed exercise apparatus according to the present invention with a roller chain for controlling extension and retraction of an upper frame;

FIG. 8(*d*) is a front wide side view of a second alternative configuration for the fifth exemplary embodiment of the bed exercise apparatus according to the present invention with spring biased detents that mate with latches for controlling extension and retraction of the upper frame with the upper frame retracted;

FIG. 8(*e*) is a front wide side view of the second alternative configuration for the fifth exemplary embodiment of the bed exercise apparatus according to the present invention with spring biased detents that mate with latches for controlling extension and retraction of the upper frame with the upper frame extended;

FIG. 9(*b*) is a front wide side view of a sixth exemplary embodiment of a bed exercise apparatus according to the present invention in a retracted position.

MODES FOR CARRYING OUT THE INVENTION

Figure 1A:
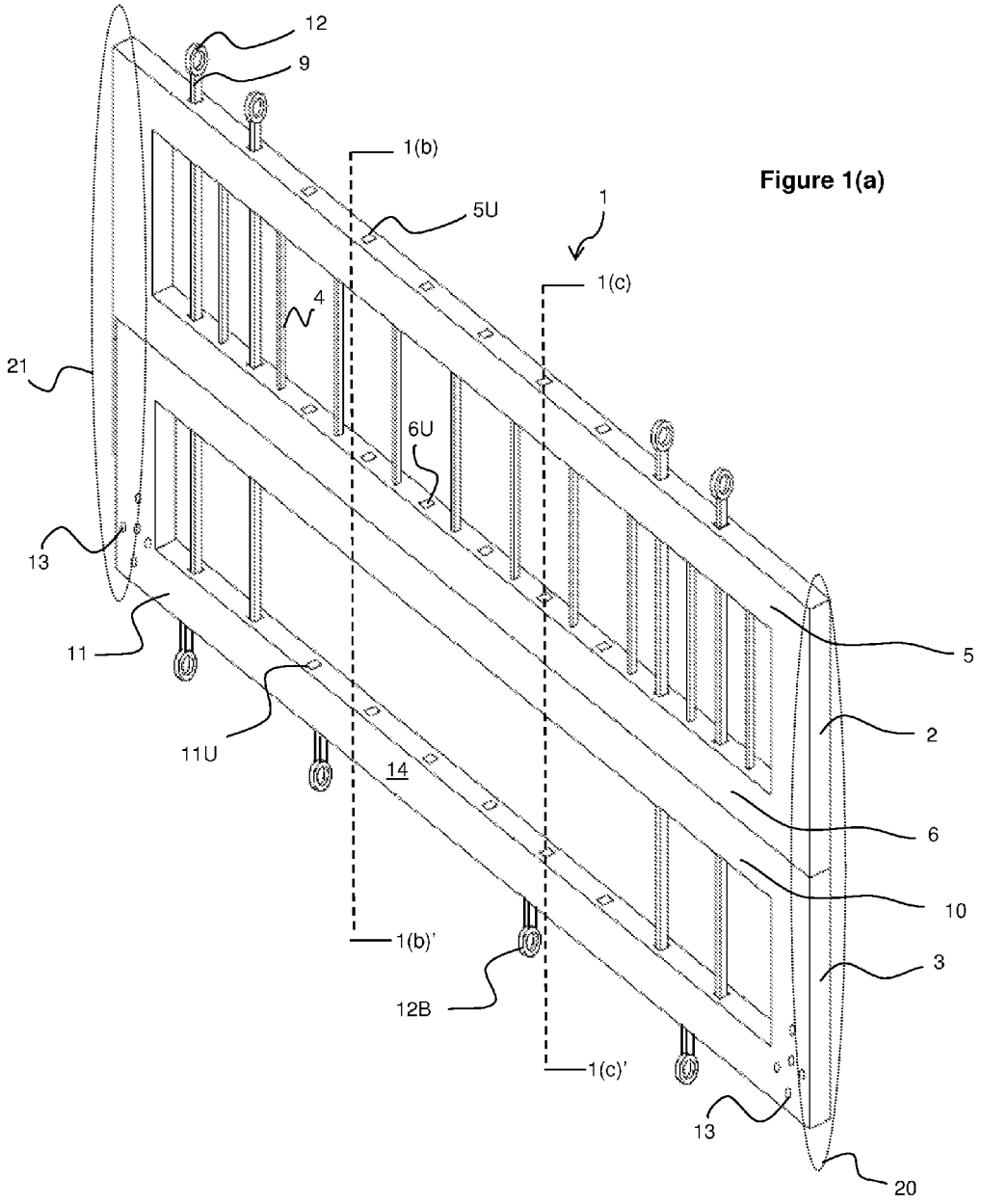
FIG. 1(*a*) is a perspective view of a first exemplary embodiment of an upper and lower frame of a bed exercise apparatus according to the present invention.
Figure 1B:
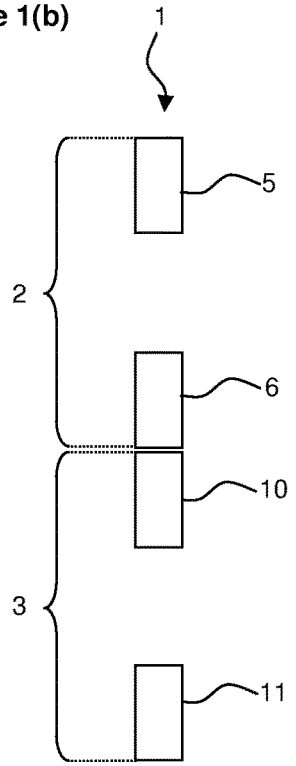
Figure 1C:
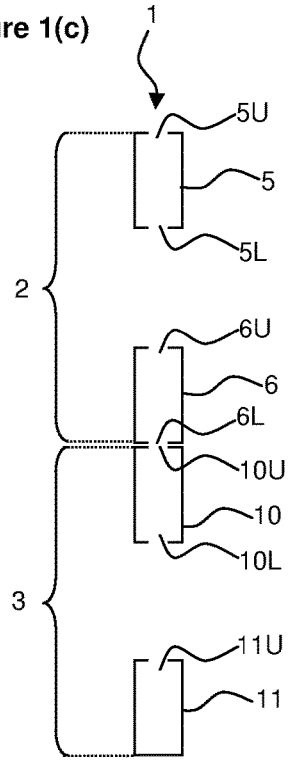
Figure 1D:
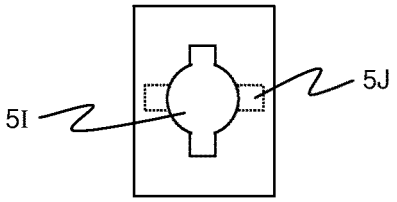
Figure 1E:
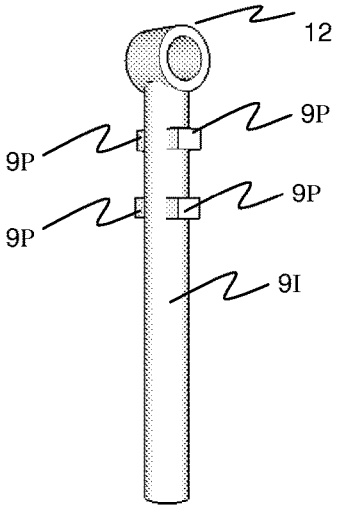

FIGS. 1-4 illustrate a first exemplary embodiment of a bed exercise apparatus 1 according to the present invention. FIG. 1 shows a perspective view of an upper frame 2 that is removably connected to a lower frame 3. with a lower side of the upper frame 2 braced flush against an upper side of the lower frame 3. The upper and lower frames 2, 3, are configured in a rectangular annular shape formed of hollow steel tubing, in which the hollow steel tubing has a rectangular cross-sectional form as may be seen in FIGS. 1(*b*) and 1(*c*). Alternatively, instead of steel tubing the upper and lower frames 2,3 may be constructed of material having a flat, U-shaped, or L-shaped profile or any other shape and may be made of other materials such as wood, plastic, other metals or any other material that can bear the load that will be placed upon it.

The upper frame 2 has several mounting bars 4 that extend from an upper crossbeam 5 of the upper frame 2 to a lower crossbeam 6 of the upper frame 2 to allow primarily for mounting of exercise equipment such as bands, ropes, and similar exercise devices. In addition, as illustrated in FIGS. 1 and 3(*b*), the lower frame 3 may have lower frame mounting rings 12B to allow for mounting of bands, ropes, and similar exercise devices as well. The lower frame mounting rings 12B are provided on a lower surface of a lower crossbeam 11 of the lower frame 3. However, lower frame mounting rings may also be positioned at other positions on the lower frame 3. Other more elaborate pieces of exercise equipment, such as pedaling devices, may also be configured to mount on the mounting bars 4 or other parts of the bed exercise apparatus 1. Conversely, the mounting bars 4 or other parts of the bed exercise apparatus 1 may be configured for attachment of the more elaborate pieces of exercise equipment. The mounting bars 4, lower frame mounting rings 12B as well as other mounting rings that attach to the upper or lower frame 2,3 may be screwed, hooked clamped, welded glued or attached by other methods known in the art.

Along an upper surface of the upper crossbeam 5 are a plurality of rod apertures 5U. As best illustrated in FIG. 1(*c*), corresponding to rod apertures 5U are a set of rod apertures 5L on the lower surface of the upper crossbeam 5 that in turn correspond to a plurality of rod apertures 6U on the upper surface of the lower crossbeam 6 and rod apertures 6L on the lower surface of the lower crossbeam 6. On the upper and lower surfaces of an upper crossbeam 10 of the lower frame 3 are rod apertures 10U and 10L, respectively, that correspond to the rod apertures 6U and 6L. In addition, on the upper surface of the lower crossbeam 11 of the lower frame 3 are rod apertures 11U that correspond with the rod apertures 10U and 10L. In this first exemplary embodiment, there are no rod apertures on the lower surface of the lower crossbeam 11 of the lower frame 3. But alternatively, such rod apertures may also be provided. Each of the corresponding sets of rod apertures 5U, 5L, 6U, 6L, 10U, 10L, 11U are aligned so as to permit rods 9 to be mounted to the bed exercise apparatus 1 by extending them through the rod apertures 5U, 5L, 6U, 6L, 10U, 10L, 11U. Alternatively, the rod 9 may extend only through the upper frame 2 apertures 5U, 5L, 6U and the rod apertures 6L, 10U, 10L and 11U may not be provided. As another alternative, the rod 9 may be mounted in the lower frame 3 only with the upper frame 2 removed. At the top of the rods 9 are mounting rings 12 to allow for mounting of exercise equipment such as bands, ropes, and similar exercise devices. As with the mounting bars 4 discussed above, other more elaborate pieces of exercise equipment may also be configured to mount on the rods 9 or other parts of the bed exercise apparatus 1.

In one alternative embodiment, the apertures 5U, 5L, 6U, 6L, 10U, 10L, 11U may be configured in an irregular shape such as an irregularly shaped aperture 5I illustrated in FIG. 1(*d*). With the irregularly shaped aperture 5I, an adjustable height rod 9I, illustrated in FIG. 1(*e*), may be used. The adjustable height rod 9I has protrusions 9P to allow for adjusting the height. When inserting and moving the adjustable height rod 9I vertically, the protrusions 9P on the adjustable height rod 9I must align with the shape of the irregularly shaped aperture 5I. Once the adjustable height rod 9I is at the desired height the adjustable height rod 9I may be rotated and the protrusions 9P may rest in indentations 5J immediately adjacent to the irregularly shaped aperture 5I. An adjustable height rod may also be configured in other manners known in the art to provide such functionality.

Figure 2:
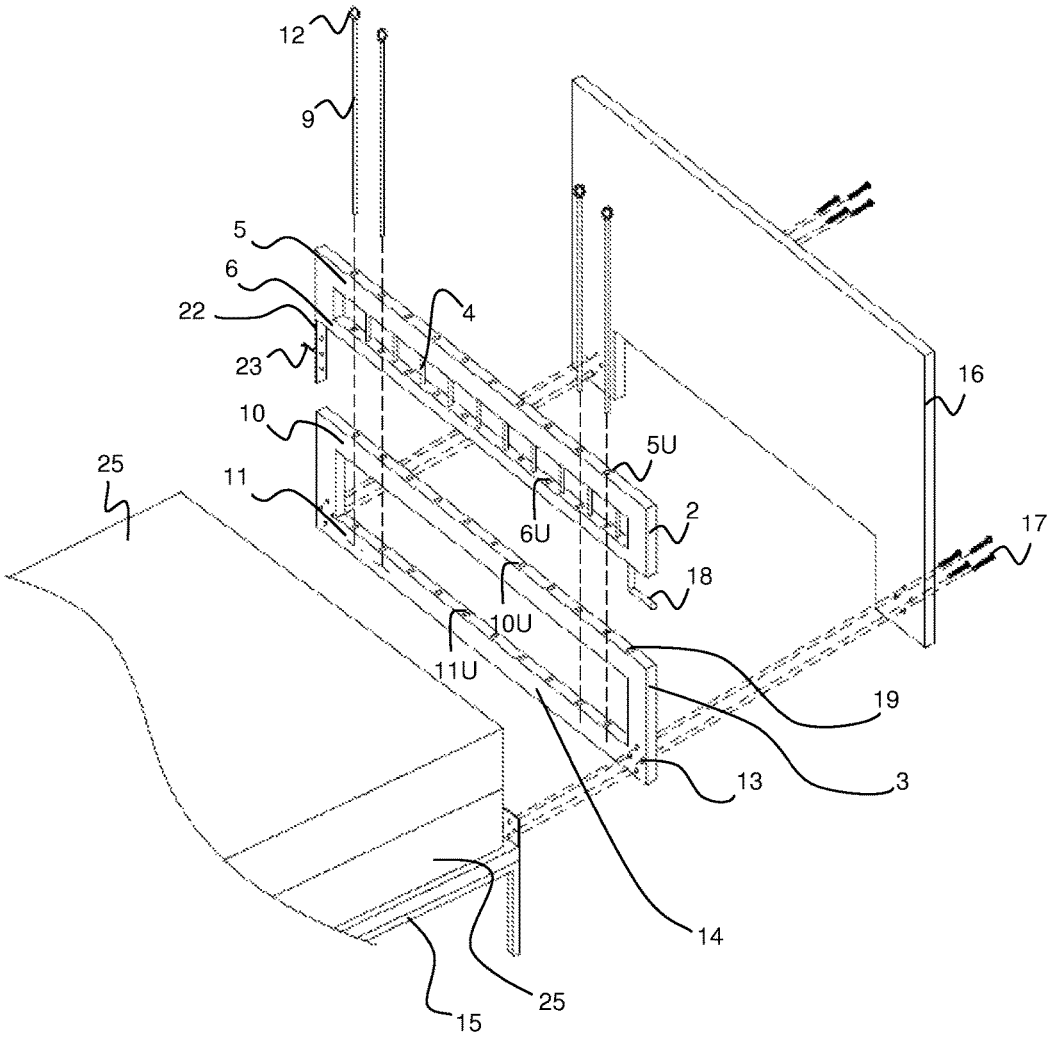
FIG. 2 is an exploded perspective view of a modified configuration of the first exemplary embodiment of the bed exercise apparatus with a headboard, bed frame, box spring and mattress according to the present invention.
Figure 3A:
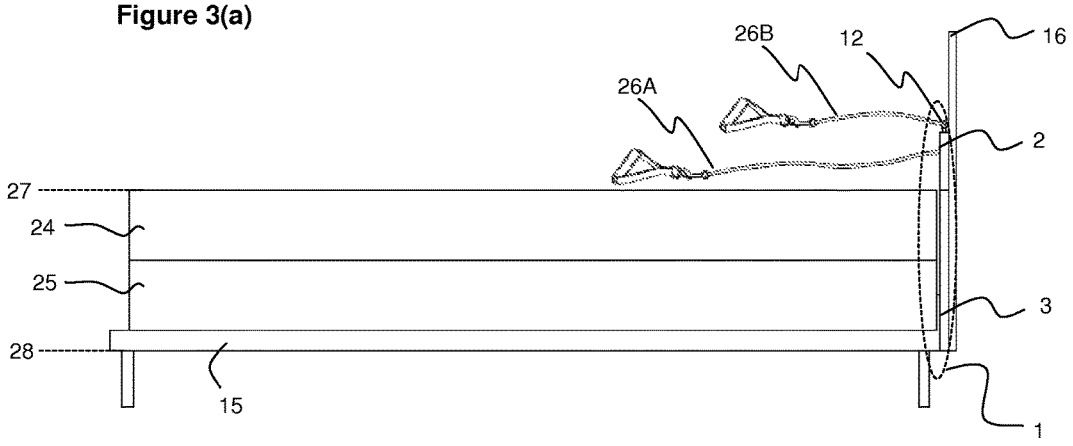
FIG. 3(*a*) is a side view of the first exemplary embodiment of the bed exercise apparatus connected to the bed frame and headboard with exemplary equipment attachments and with the box spring and mattress according to the present invention.
Figure 3B:
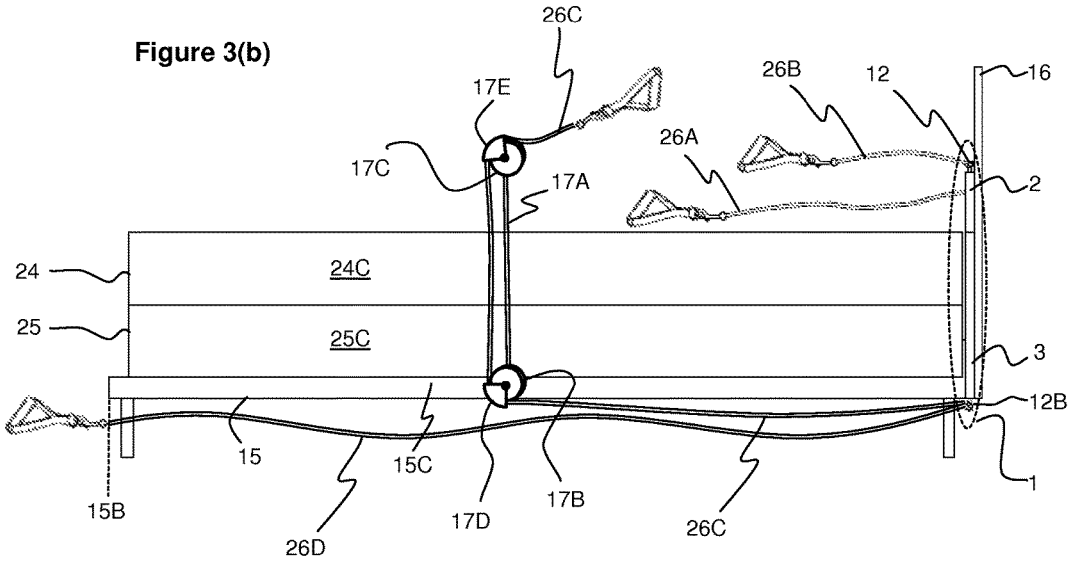
Figure 3C:
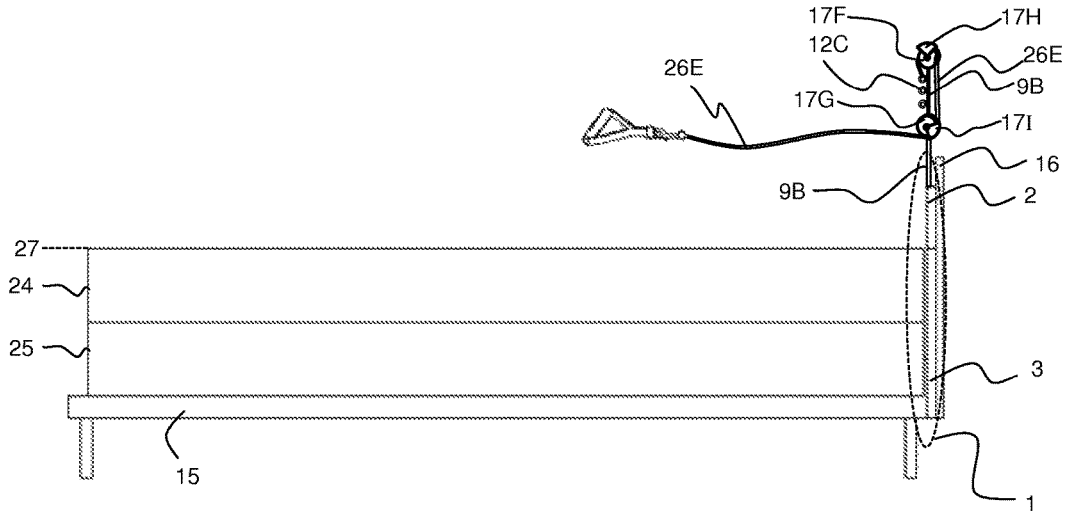
Figure 3D:
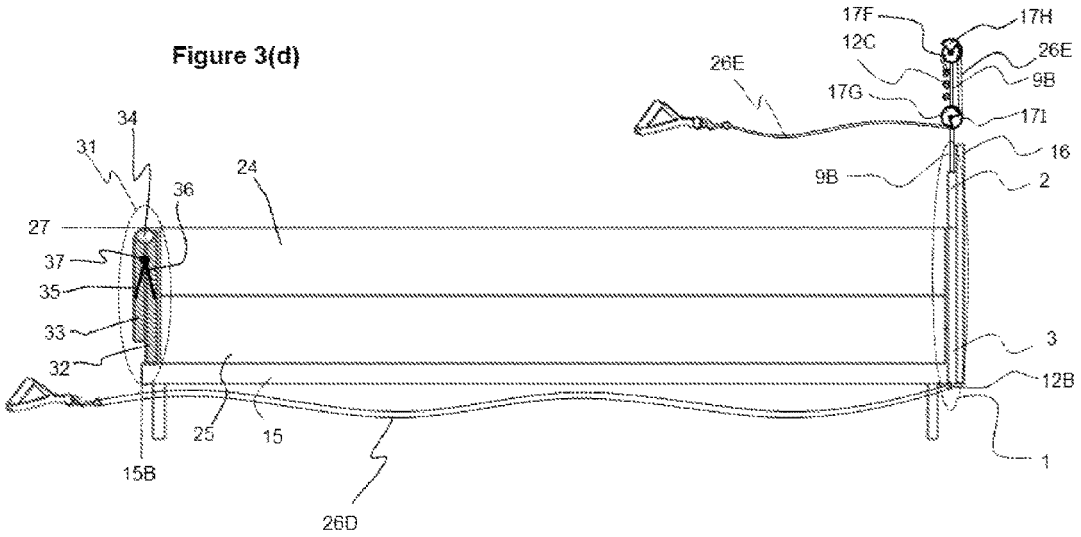
Figure 3E:
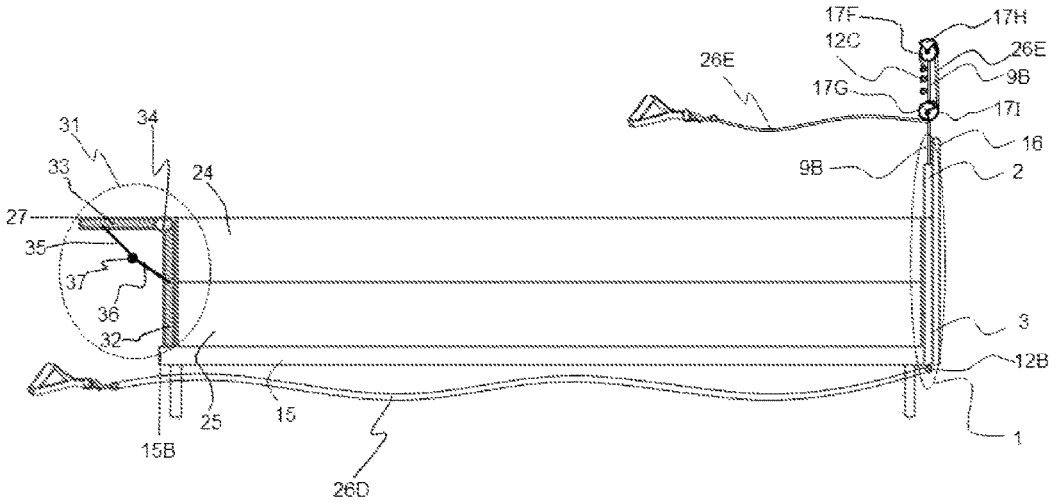

On the lower frame 3, are apertures 13 that extend from a first wide side 14 to an opposing wide side (not shown) to allow for the lower frame to be securely mounted to a bed frame 15 and to a headboard 16 with bolts 17, as may be seen in FIG. 2. Alternatively, clamps may be employed to mount the lower frame 3 to the bed frame 15 The lower frame 3 may also have a bracing bar 17A that extends from the first wide side 14 of the lower frame 3 so as to attach to a middle cross beam 15A of the bed frame 15, as may be seen in FIG. 4. Alternatively, the apertures 13 may be provided on the upper frame 12 and the upper frame 12 may be connected to the bed frame 15 and the headboard 16 without use of the lower frame 13, or upper and lower frames 12 and 13 may be one integral piece so that the upper frame 12 cannot be disconnected from the lower frame 13. Similarly, in another alternative embodiment, the lower frame 3 may be provided as an integral part of the bed frame 15 thereby obviating the need for the apertures 13. In such an embodiment, the upper and lower frames 12 and 13 may or may not also be one integral piece. Alternatively, in certain instances it may be practical to wedge the bed exercise apparatus 1 in place between the bed frame 15 and the headboard 16 without using fasteners through apertures 13. As another alternative, the bed exercise apparatus 1 may be mounted on a far side of the headboard 16 i.e. with the headboard 16 between the bed exercise apparatus 1 and the mattress 15, where the headboard 16 has sufficient openings to accommodate exercise equipment to pass therethrough. In a further alternative, the bed exercise apparatus 1 may be mounted to the bed frame only without the use of the headboard 16; this is particularly practical where the bed exercise apparatus 1 is located next to a wall.

Furthermore, as seen in FIG. 2, the upper frame 2 has a mounting elbow 18 that is configured to fit into a mounting aperture 19 on the lower frame 3 such that when first mounting the upper frame 2 on the lower frame 3, the lower surface of the upper frame 2 is perpendicular to the upper surface of the lower frame 3 and then the upper frame 2 is rotated so as to bring the lower surface of the lower crossbeam 6 of the upper frame 2 into flush contact with the upper surface of the upper crossbeam 10 of the lower frame 3, and thereby securing the upper frame 2 and the lower frame 3 on a first narrow side 20. On a second narrow side 21 is a mounting bracket 22 that is integral with the upper frame 2 that allows for securing the upper frame 2 to the lower frame 3 on the second side 21 with one or more bolts 23. Alternatively, the upper frame 2 and lower frame 3 may be configured to fit together via a tongue and groove system allowing the upper frame 2 to slide in and out via an opening in the groove. The upper surface of the upper crossbeam 10 may include a padding material layer so as to prevent injury when the upper frame is disconnected and thereby exposes the upper surface of the upper crossbeam 10. Similarly, other parts of the upper and lower frames 2, 3 may include padding on exposed surfaces.

FIG. 3(*a*) shows a side view of the bed exercise apparatus 1 mounted with the bed frame 15 and the headboard 16. As may be seen in FIG. 3(*a*), the bed exercise apparatus 1 fits in well and does not interfere with box spring 25 and mattress 24. If the bed frame 15, headboard 16, box spring 25 or mattress 24 are irregularly shaped, then the configuration of the lower and/or upper frames 3, 2 may be adjusted to conform to their shapes. The upper and lower frames 2, 3 may be configured to be adjustable in both width and height to fit various bed sizes and different types of bed frames. Attached to one of the mounting bars 4 (not shown in FIG. 3(*a*)) is an exercise band 26A and attached to one of the mounting rings 12 is a second exercise band 26B. As illustrated in FIG. 3(*a*), the lower frame 3 extends up to a top surface 27 of the mattress 24 and does not extend above that level. Alternatively, the lower frame 3 may extend above or terminate below the top surface 27 of the mattress 24. Also, the bottom of the lower frame 3, as illustrated in FIG. 3, extends to a lower surface 28 of the bed frame 15. Alternatively, the lower frame 3 may either extend further down, even possibly to the floor, for additional support, or terminate above the lower surface 28 of the bed frame 15.

FIG. 3(*b*) shows another side view of the bed exercise apparatus 1 mounted with the bed frame 15 and the headboard 16 with alternative exemplary equipment attachments to the lower frame mounting rings 12B. Attached to one of the lower frame mounting rings 12B is an exercise band 26D that extends to a bed frame distal end 15B. This provides for the possibility of using the exercise apparatus 1 to perform leg or possibly upper body exercises while sitting at the bed frame distal end 15B. A plurality of exercise bands, ropes or other exercise devices may be attached to lower frame mounting rings 12B and extend to the bed frame distal end 15B so as to allow for exercising two or more limbs at a time.

Additionally, as illustrated in FIG. 3(*b*), an exercise band 26C attached to one of the lower frame mounting rings 12 extends to a side pole 17A that is mounted to a broad side 15C of the bed frame 15 and/or the broad side 25C of the box spring 25 and/or the broad side 24C of the mattress 24. On the side pole 17A are sheaves 17B, 17C with sheave guards 17D, 17E that guide the exercise band 26C from underneath the bed frame 15 up along sides of the bed frame 15, box spring 25 and mattress 24. The side pole 17C may be height adjustable. A plurality of similar side poles may be positioned along the bed frame broad side 25C or on the opposing bed frame broad side or both and also at the bed frame distal end 15B to perform exercises from almost any angle.

FIG. 3(*c*) shows another side view of the bed exercise apparatus 1 mounted with the bed frame 15 and the headboard 16 with alternative exemplary equipment attachments. A rod 9B is mounted to the exercise apparatus 1 by extending through the rod apertures 5U, 5L, 6U, 6L, 10U, 10L, 11U in the upper and lower frames 2, 3. The rod 9B has one or more mounting hooks 12C along a side of the rod 9B with a top sheave 17F with a sheave guard 17H at the top of the rod 9B and a bottom sheave 17G with a sheave guard 17I mounted lower on the rod 9B. The lower guide sheave 17I is preferably provided on the rod 9B just above the point where the rod 9B enters the rod aperture 5U. An exercise band 26E is hooked onto one of the mounting hooks 12C and extends up riding over the top sheave 17F and then extends downward and around the bottom sheave 17G. The rod 9B may be configured as an adjustable height rod in the manner discussed above by the adjustable height rod 9I or in another manner known in the art to provide such functionality.

FIGS. 3(*d*) and 3(*e*) show another side view of the bed exercise apparatus 1 mounted with the bed frame 15 and the headboard 16 with alternative exemplary equipment attachments. The configuration shown in FIGS. 3(*d*) and 3(*e*) includes the rod 9B discussed above with reference to FIG. 3(*c*) and the other associated elements discussed above. The configuration shown in FIGS. 3(*d*) and 3(*e*) also includes a lower frame mounting ring 12B with the exercise band 26D that extends to the bed frame distal end 15B. In addition, FIGS. 3(*d*) and 3(*e*) show an exemplary mattress extender 31 in a closed and open position, respectively. A mattress extender base 32 is mounted to the bed frame 15 on or proximal to the bed frame distal end 15B. Via a hinge 34 a mattress extender support surface 33 is rotatably connected to the mattress extender base 32. The mattress support surface 33 may extend across an entire width of the mattress 24 or a portion thereof. The mattress extender may also include one or more folding braces 38. The folding braces may be configured with a first link 35 that is rotatably connected via a hinge 37 to a second link 38. The first link 35 is rotatably attached to the mattress extender support surface 33 and the second link 38 rotatably connects to the mattress extender base 32. The mattress extender may, in an alternative embodiment, be configured to be fixed in an extended position with no hinge 34 and without folding braces 38. The mattress extender 31 may also, alternatively, be configured to attach to a footboard or the mattress 24 or box spring 25. The mattress extender 31 may be used to provide additional space for doing exercises while lying on the mattress 24 or it may be used for doing exercises in a sitting position.

Figure 4:
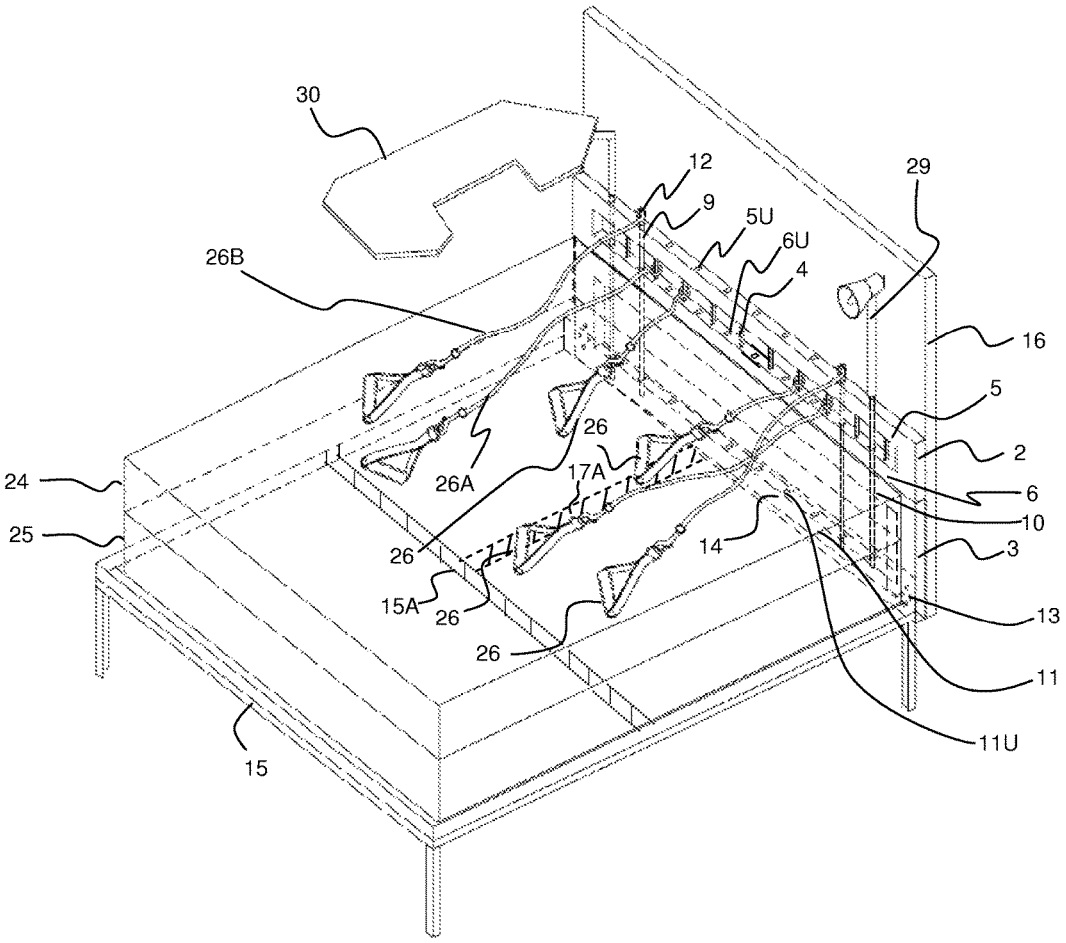
FIG. 4 is a perspective view of the modified configuration of the first exemplary embodiment of the bed exercise apparatus according to the present invention connected to the bed frame and headboard.

FIG. 4 shows a perspective view of the bed exercise apparatus 1 mounted with the bed frame 15 and the headboard 16. In this configuration, in addition to exercise bands 26A and 26B, there are several other exercise bands 26 attached both to the mounting bars 4 and the mounting rings 12. As illustrated, a desk 30 may also be mounted onto the bed exercise apparatus 1. As shown in the exemplary embodiment, the desk 30 is rotatable so as to move it out of the way when not in use. The desk 30 may be removably mounted onto one of the rods 9 or may be integrally attached onto its own rod for mounting on the bed exercise apparatus 1. Also, as illustrated in FIG. 4, a lamp 29 may be mounted onto the bed exercise apparatus 1. The lamp 29 may be removably mounted onto one of the rods 9 or may be integrally attached onto its own rod for mounting on the bed exercise apparatus 1.

Figure 5:
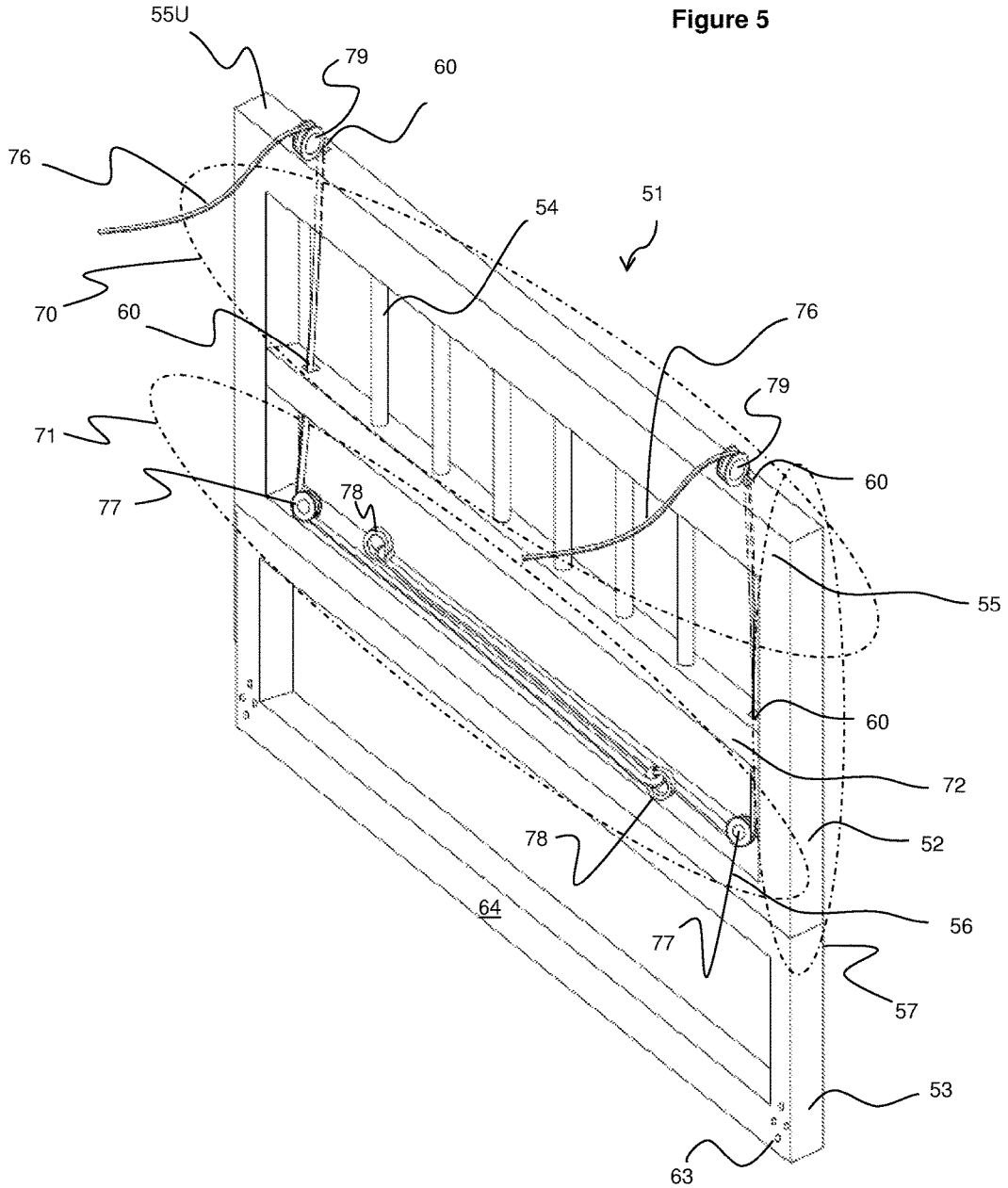
FIG. 5 is a perspective view of a second exemplary embodiment of the bed exercise apparatus according to the present invention.

FIG. 5 shows a perspective view of a second exemplary embodiment of a bed exercise apparatus 51 according to the present invention. The bed exercise apparatus 51 has a lower frame 53 and an upper frame 52 that is removably connected to the lower frame 53 in the same manner as bed exercise apparatus 1. The upper frame 52 has a bisecting crossbeam 72 that bisects the upper frame 52 into an upper portion 70 and a lower portion 71. The upper frame 52 has several mounting bars 54 that extend from an upper crossbeam 55 of the upper frame 52 to the bisecting crossbeam 72 of the upper frame 52. Elongated exercise bands 76 are mounted to lower section rings 78 which are affixed to an upper surface of a lower crossbeam 56. The elongated exercise bands 76 extend through a groove on lower sheaves 77, which guide the elongated exercise bands 76 through a set of elongated exercise band guide apertures 60 in the bisecting crossbeam 72 and upper crossbeam 55. The elongated exercise band guide apertures 60 allow the elongated exercise bands 76 to extend through the bisecting crossbeam 72 and upper crossbeam 55 to an upper surface 55U of the upper crossbeam 55. The elongated exercise bands 76 then extend through a groove on upper sheaves 79 which guide the elongated exercise bands 76 toward a mattress on a bed frame to which the exercise apparatus 51 is connected on a first wide side 64. On the lower frame 53, are apertures 63 that extend from the first wide side 64 to an opposing wide side (not shown) to allow for the lower frame 53 to be securely mounted to a bed frame and to a headboard with bolts similar to the manner in which exercise apparatus 1 is connected to the bed frame 15 and headboard 16 as may be seen in FIG. 2. Alternatively, the apertures 63 may be provided on the upper frame 52 and the upper frame 52 may be connected to the bed frame and the headboard without use of the lower frame 53, or upper and lower frames 52 and 53 may be one integral piece so that the upper frame 52 cannot be disconnected from the lower frame 53. In addition, similar to the bed exercise apparatus 1, the bed exercise apparatus 51 may include rods similar to the rods 9 and rod apertures similar to the rod apertures 5U, 5L, 6U, 6L, 10U, 10L, 11U, in exercise apparatus 1. The rod apertures may allow such rods in the bed exercise apparatus 51 to extend alternatively through both the upper frame 52 and the lower frame 53 or only through the entire upper frame 52, or only through the upper portion 70 of the upper frame 52.

Figure 6:
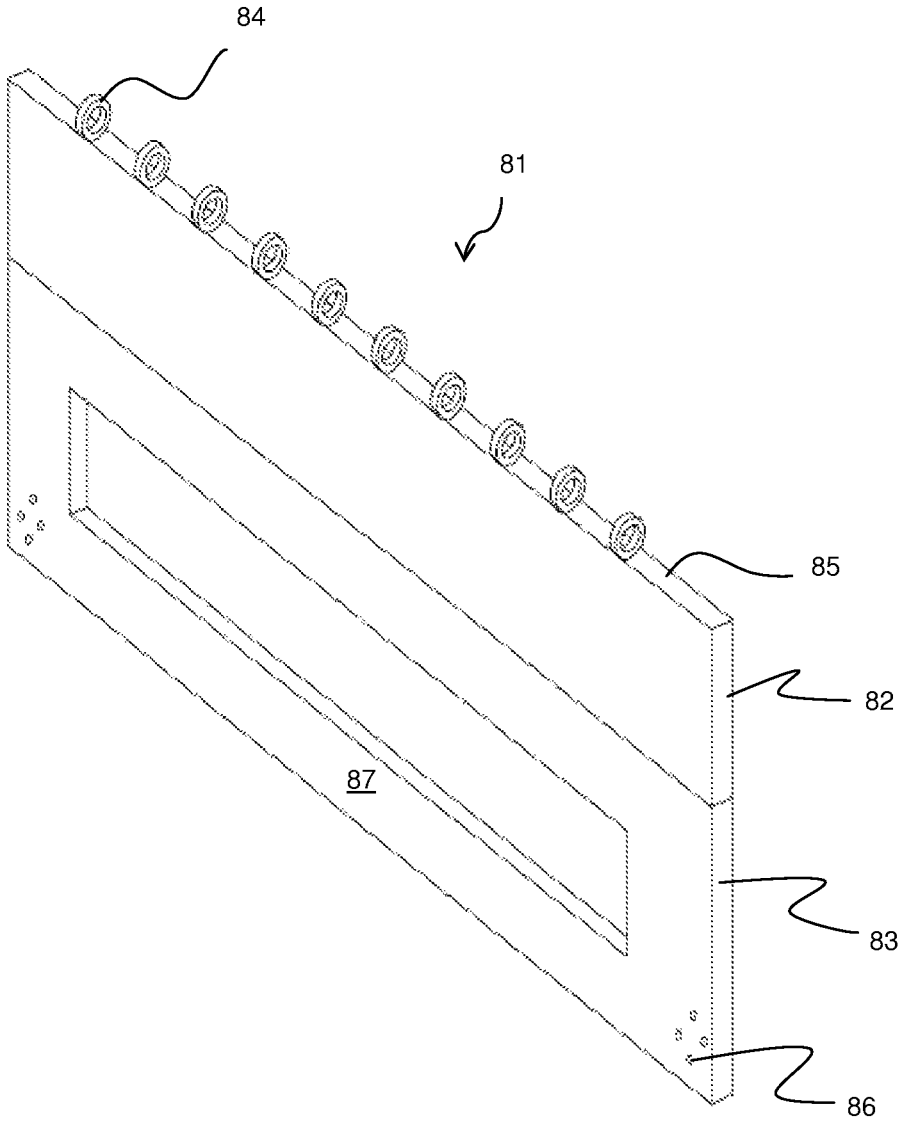
FIG. 6 is a perspective view of a third exemplary embodiment of the bed exercise apparatus according to the present invention.

FIG. 6 shows a perspective view of a third exemplary embodiment of a bed exercise apparatus 81 according to the present invention. The bed exercise apparatus 81 has a lower frame 83 and an upper frame 82 that is removably connected to the lower frame 83 in the same manner as bed exercise apparatus 1. On an upper surface 85 of the upper frame 82 are mounting rings 84. Alternatively, in place of the mounting rings 84 may be any other connecting structure to allow for fixedly connecting exercise equipment to the exercise apparatus such as the exemplary configurations disclosed herein. Similarly, the configuration of mounting rings directly mounted onto and proximate to an upper surface of an upper frame may be used in conjunction with other embodiments such as the exemplary embodiments disclosed herein. The upper frame 82 has a solid rectangular configuration as opposed to the annular configuration of upper frames in the previous exemplary embodiments of the exercise apparatus according to the present invention. The frame 82 may, alternatively, be configured with an annular upper frame configuration and similarly other exemplary embodiments of the exercise apparatus may be configured with an upper frame with a solid rectangular configuration instead of providing mounting bars.

On the lower frame 83, are apertures 86 that extend from a first wide side 87 to an opposing wide side (not shown) to allow for the lower frame 53 to be securely mounted to a bed frame and to a headboard with bolts similar to the manner in which bed exercise apparatus 1 is connected to the bed frame 15 and headboard 16, as may be seen in FIG. 2. Alternatively, the apertures 86 may be provided on the upper frame 82 and the upper frame 82 may be connected to the bed frame and the headboard without use of the lower frame 83, or upper and lower frames 82 and 83 may be one integral piece so that the upper frame 82 cannot be disconnected from the lower frame 83.

Figure 7A:
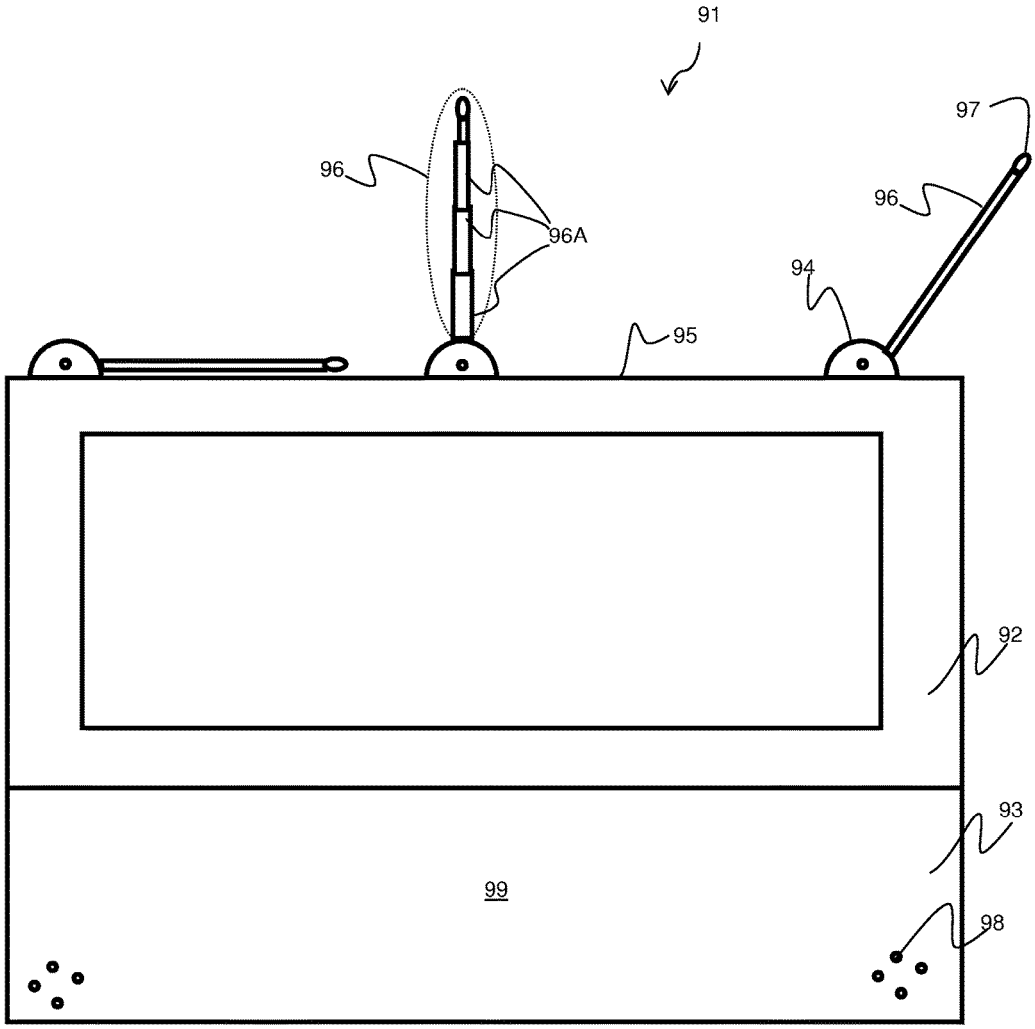
FIG. 7(*a*) is a first wide side view of a fourth exemplary embodiment of the bed exercise apparatus according to the present invention.
Figure 7B:
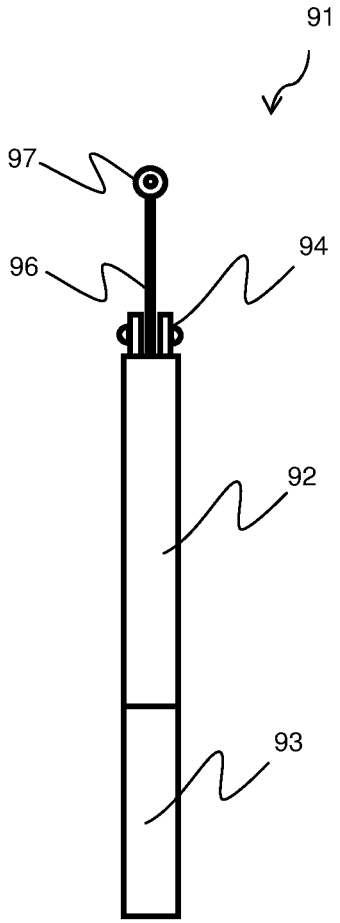
Figure 8A:
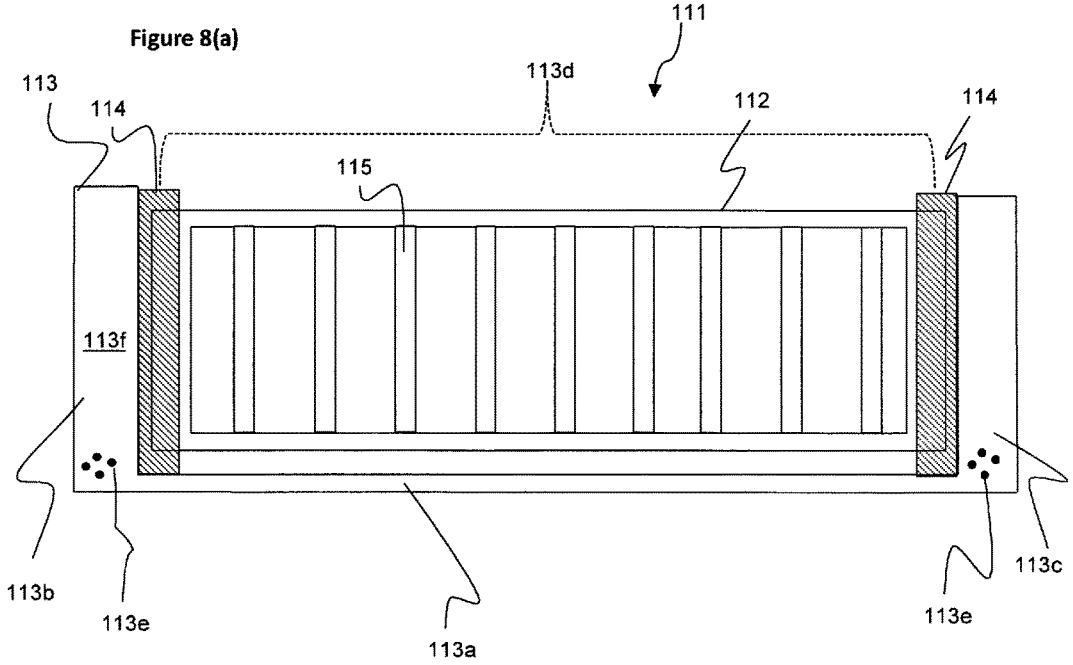
FIG. 8(*a*) is a front wide side view of a fifth exemplary embodiment of the bed exercise apparatus according to the present invention.
Figure 8B:
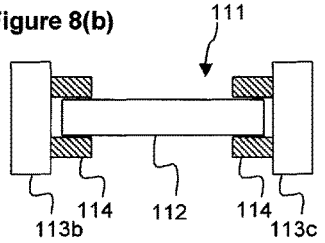
Figure 8C:
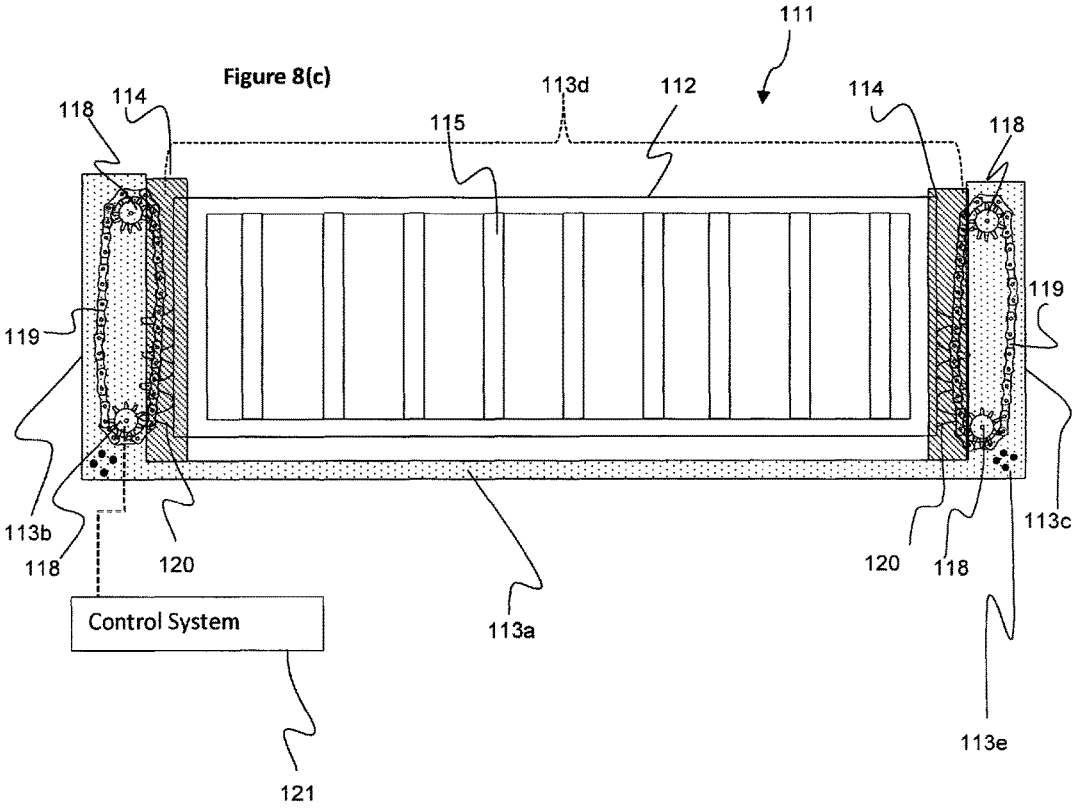
Figure 8D:
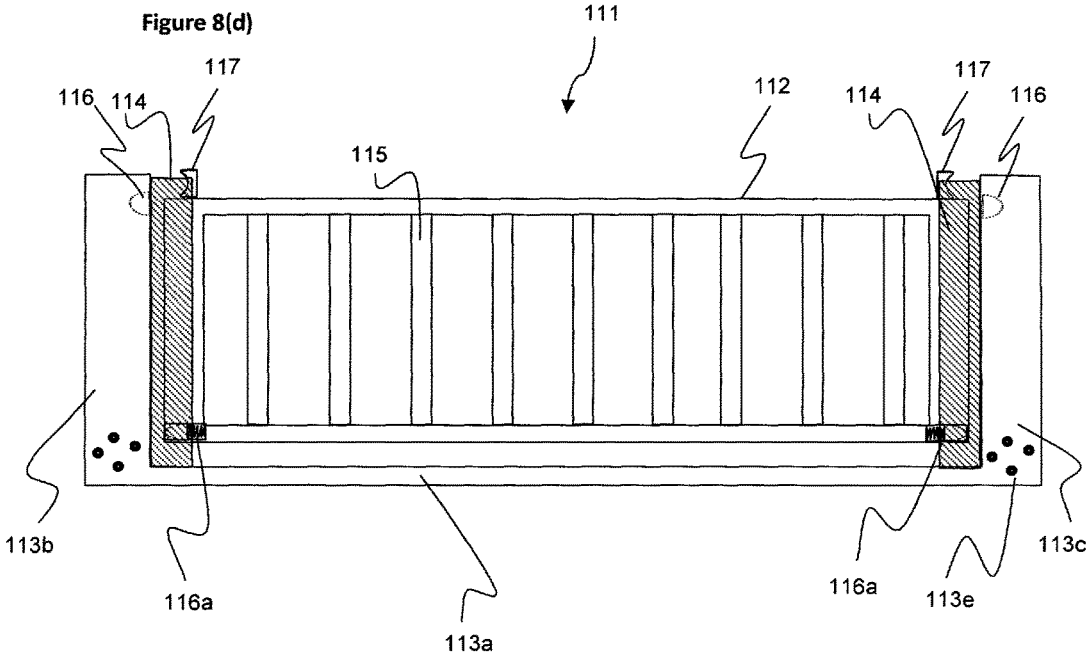
Figure 8E:
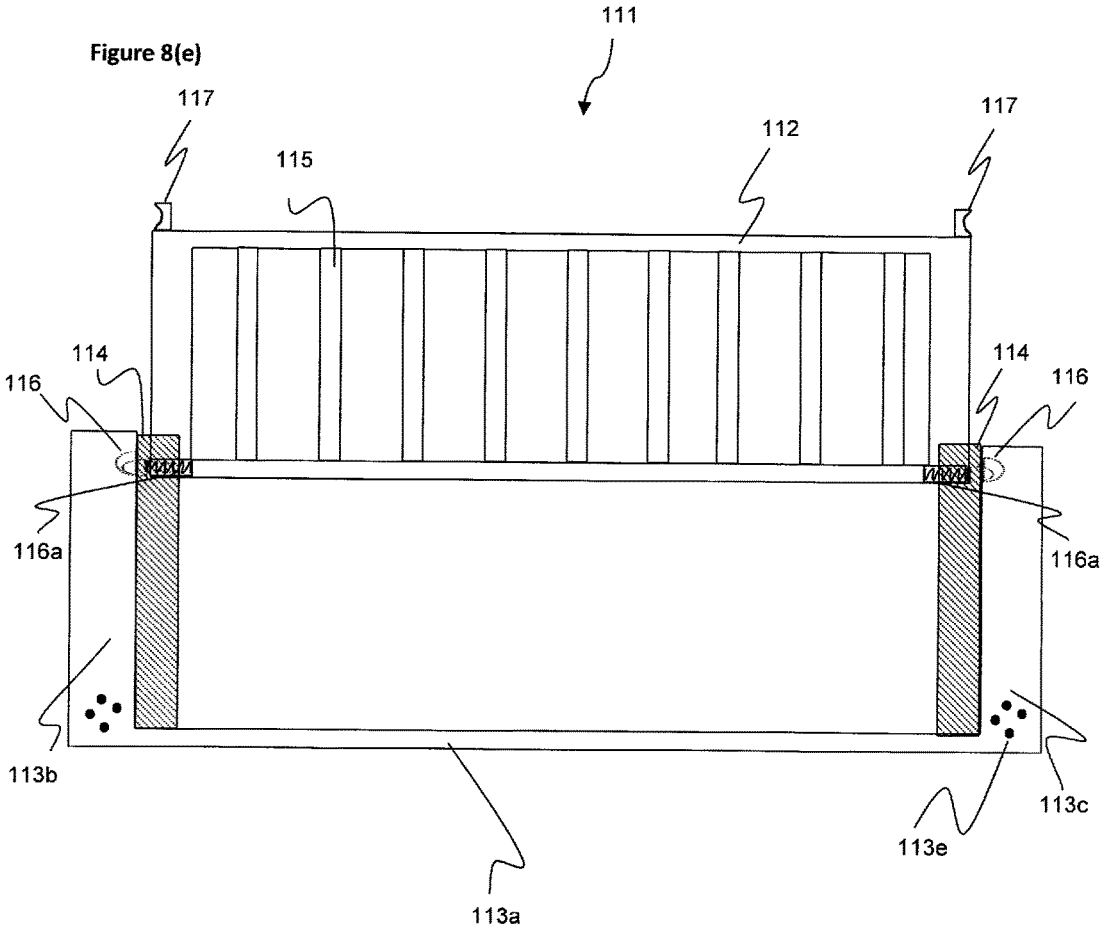

FIGS. 7(*a*) and 7(*b*) show a first wide side view and a first narrow side view, respectively, of a fourth exemplary embodiment of a bed exercise apparatus 91 according to the present invention. The bed exercise apparatus 91 has a lower frame 93 and an upper frame 92 that is removably connected to the lower frame 93 in the same manner as bed exercise apparatus 1. On an upper surface 95 of the upper frame 92 are hinges 94. Rotatably mounted on the hinges 94 are rotatable rods 96. On the ends of the rotatable rods 96 that are distal to the hinges 94 are mounting rings 97. Alternatively, in place of the mounting rings 97 can be any other connecting structure to allow for fixedly connecting exercise equipment to the exercise apparatus. The hinges 94 may be detent hinges or friction hinges or any other hinge that allows rotating the rotatable rods 96 into multiple positions so that the mounting rings 97 may be positioned at various heights. Furthermore, the rotatable rods 96 may be comprised of two or more nested rod portions 96A so as to be capable of telescoping.

On the lower frame 93, are apertures 98 that extend from a first wide side 99 to an opposing wide side (not shown) to allow for the lower frame to be securely mounted to a bed frame and to a headboard with bolts similar to the manner in which bed exercise apparatus 1 is connected to the bed frame 15 and headboard 16 as may be seen in FIG. 2. Alternatively, the apertures 98 may be provided on the upper frame 92 and the upper frame 92 may be connected to the bed frame and the headboard without use of the lower frame 93, or upper and lower frames 92 and 93 may be one integral piece so that the upper frame 92 cannot be disconnected from the lower frame 93. In addition, similar to the bed exercise apparatus 1, the bed exercise apparatus 91 may include mounting bars similar to the mounting bars 4, rods similar to the rods 9, and rod apertures similar to the rod apertures 5U, 5L, 6U, 6L, 10U, 10L, 11U, as well as apertures not shown in the Figures. The rod apertures may allow such rods in the bed exercise apparatus 91 to extend alternatively through both the upper frame 92 and the lower frame 93 or only through the entire upper frame 92.

FIGS. 8(*a*) and 8(*b*) show a first wide side view and a top view, respectively, of a fifth exemplary embodiment of a bed exercise apparatus 111 according to the present invention. The bed exercise apparatus 111 has a lower frame 113 that has a lower crossbeam 113*a*, side beams 113*b*, 113*c* and an open upper side 113*d* that extends between the upper ends of the side beams 113*b*, 113*c*, the upper ends being distal to the lower crossbeam 113*a*. Extending along a portion or the entire length of inner sides of the side beams 113*b*, 113*c* are slide tracks 114. An upper frame 112 with several mounting bars 115 is slidably positioned on the slide tracks 114 so that the upper frame 112 may slide through the open upper side 113*d*. Alternatively, the side beams 113*b*, 113*c* may extend very high and, therefore, the upper side 113*d* of the lower frame does not need to be open and the upper frame 112 simply slides within the lower frame 113. The upper frame 112 and the slide tracks 114 are configured to allow the upper frame to stay fixedly positioned at one or more positions. This may be accomplished by having a high friction interface between the slide tracks 114 and the upper frame 112. On the lower frame 113, are apertures 113*e* that extend from a first wide side 113*f* to an opposing wide side (not shown) to allow for the lower frame to be securely mounted to a bed frame and to a headboard with bolts similar to the manner in which bed exercise apparatus 1 is connected to the bed frame 15 and headboard 16 as may be seen in FIG. 2.

FIG. 8(*c*) shows a front wide side view of an alternate exemplary configuration of the bed exercise apparatus 111 according to the present invention. In this configuration, a roller chain 119 mounted on a pair of sprockets 118 is provided in both of the slide tracks 114. Teeth 120 on the upper frame mesh with the roller chain 119, allowing the upper frame 112 to move up and down as the roller chain 119 rides on the sprockets 118. One or more of the sprockets 118 may be connected to a control system 121, which may be any mechanical or electromechanical device that can drive or control the movement of the sprockets. The control system 121 may be comprised of either a motor with a switch control or a hand crank to drive the sprockets 118 and thereby the roller chain 119 to extend and retract the upper frame 112. Alternatively, the control system 121 may be employ of one or more inertial or frictional elements such as a brake and a flywheel that may be used to restrict movement of the sprockets 118 and roller chain 119 unless a certain amount of manual pressure is applied when extending or retracting the upper frame 112.

In a further alternative, as illustrated in FIGS. 8(*d*) and 8(*e*) the upper frame 112 may have spring biased detents 116*a* that can extend out from the upper frame 112 and latch with one or more latching notches 116 in the slide tracks 114 or the side beams 113*b*, 113*c*. The spring biased detents 116*a* may be retracted from the latching notches 116 via mechanically connected detent controls 117. In FIG. 8(*d*) the upper frame 112 is in a retracted position and the spring biased detents 116*a* are retracted and not latched in latching notches 116. In this state, the upper frame 112 may be moved up or down. In FIG. 8(*e*), the upper frame 112 is in an extended position and the spring biased detents 116*a* are extended and latched in latching notches 116, locking the upper frame 112 in place. Although only one set of notches are shown, there may be several pairs of notches to lock the upper frame 112 in at various heights including at a fully retracted position.

Figure 9A:
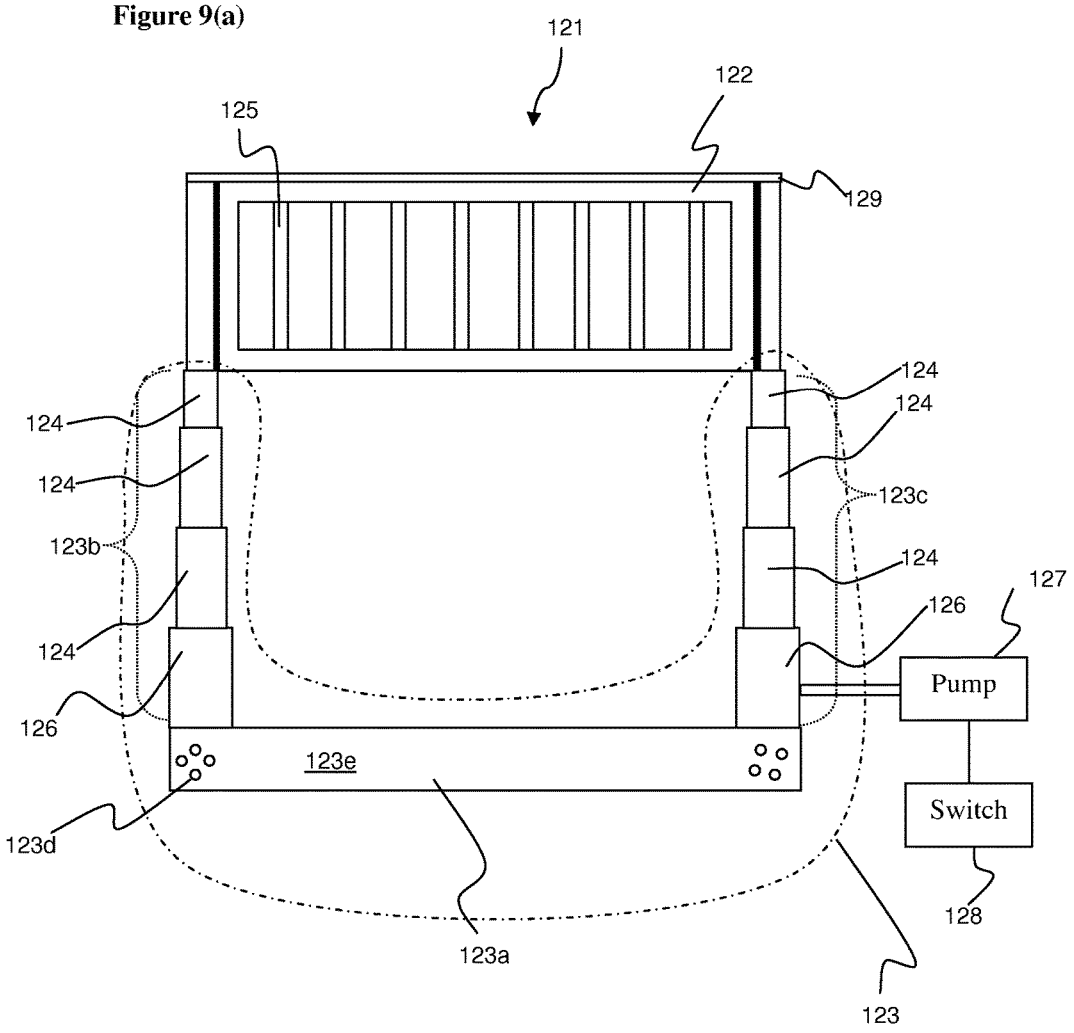
FIG. 9(*a*) is a front wide side view of a sixth exemplary embodiment of the bed exercise apparatus according to the present invention with an upper frame in an extended position.
Figure 9B:
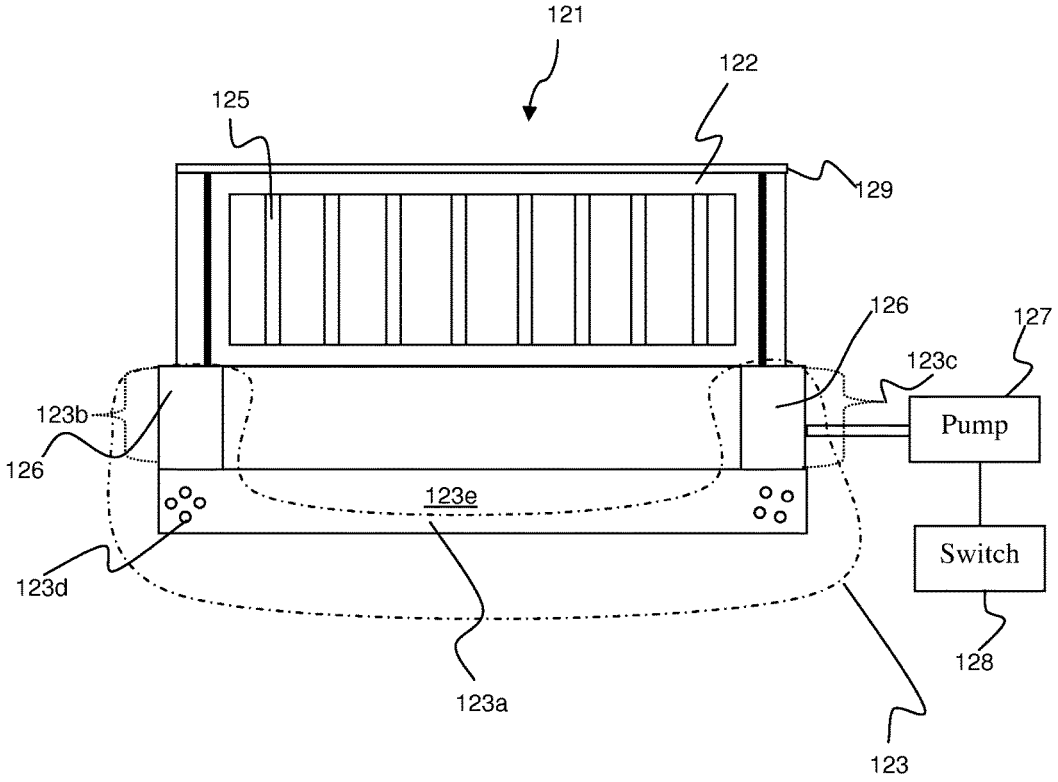

FIGS. 9(*a*) and 9(*b*) show a front wide side view of a sixth exemplary embodiment of a bed exercise apparatus 121 according to the present invention in an extended and retracted position, respectively. The bed exercise apparatus 121 has a lower frame 123 that has a lower crossbeam 123*a* and side beams 123*b*, 123*c*. The side beams 123*b*, 123*c* are configured as telescoping beams comprised of two or more nested beam portions 124 that are configured to allow the side beams 123*b*, 123*c* to extend and retract. An outermost nested beam portion 126 connected to the lower crossbeam 123*a* forms a base of each of the side beams 123*b*, 123*c*. An upper frame 122 is fixedly connected to the innermost one of the nested side beam portion 124 so that the side beams 123*b*, 123*c* can raise and lower the upper frame 122 as the side beams 123*b*, 123*c* extend and retract. The side beams 123*b*, 123*c* may be configured as hydraulic cylinders. In this case, a hydraulic oil or air pump 127 connects to the side beams 123*b*, 123*c* and allows a user to conveniently raise and lower the upper frame 122 via a control switch 128 connected to the hydraulic pump 127. The upper frame 122 is shown with mounting bars 125 for attaching various types of exercise equipment. For the bed exercise apparatus 121, as with the alternative exemplary exercise apparatus embodiments 51, 81, 91, 111, the upper frame 122 and possibly the lower frame 123 may be configured with apertures to accommodate rods such as the rod 9 or the adjustable rod 91 discussed above and the lower frame 123 may include lower frame mounting rings as discussed above. In addition, the bed exercise apparatus 121, as with the alternative exemplary exercise apparatus embodiment 111, may be configured to allow for the upper frame 122 to completely retract below a mattress top surface level and, thereby, hide the upper frame 122 when it is not in use. In addition, the bed exercise apparatus 121, as with the alternative exemplary exercise apparatus embodiment 111, may have along a top surface of the upper frame 122 a cushioning layer 129. The bed exercise apparatus 121 may be configured so that when the upper frame 122 is completely retracted the cushioning layer is aligned with a top surface of a mattress. Similar cushioning layers may be provided on other exposed surfaces of the exercise apparatus 121 and on the exposed surfaces of the other exemplary exercise apparatus embodiments discussed herein. On the lower frame 123, are apertures 123*d* that extend from a first wide side 123*e* to an opposing wide side (not shown) to allow for the lower frame to be securely mounted to a bed frame and to a headboard with bolts similar to the manner in which bed exercise apparatus 1 is connected to the bed frame 15 and headboard 16 as may be seen in FIG. 2.

The embodiments of the invention described herein are exemplary in nature, and therefore, the spirit and the scope of the invention are by no means restricted to what is described above or intended to represent every possible embodiment of the invention. For example, a bed frame is not limited to a frame but includes any structure that may be used to support a mattress. Moreover, the upper frame of the exercise apparatus may be configured in an upside down "U" shape, i.e. with no lower crossbeam. In addition, the bed exercise apparatus may be configured with more than one set of attachments so that more than one person can exercise at the same time. It should also be noted that the terms headboard and footboard are essentially interchangeable and structural limitations and variations discussed by one exemplary embodiment of the bed exercise apparatus may be applied to the other exemplary embodiments as well.

What is claimed is:

1. A bed exercise apparatus for a bed with a bed frame, and a headboard positioned by a head of the bed frame, the bed exercise apparatus comprising:

a. a lower frame disposed between the head of the bed frame and the headboard; and b. an upper frame with exercise equipment mounting connections, the upper frame configured to connect to the lower frame in such manner that all or a portion of the upper frame may be disposed above a top surface of the lower frame, wherein the upper frame has an upper crossbeam and lower crossbeam and one or more mounting bars as exercise equipment mounting connections extending from the upper crossbeam to the lower crossbeam.

2. A bed exercise apparatus for a bed with a bed frame, and a headboard positioned by a head of the bed frame, the bed exercise apparatus comprising:

a. a lower frame disposed between the head of the bed frame and the headboard; and b. an upper frame with exercise equipment mounting connections, the upper frame configured to connect to the lower frame in such manner that all or a portion of the upper frame may be disposed above a top surface of the lower frame; and c. a rod, wherein the upper frame has an upper frame upper crossbeam and an upper frame lower crossbeam and a set of rod apertures comprised of a first rod aperture in a top surface of the upper frame upper crossbeam, the rod extending through the set of rod apertures.

3. The bed exercise apparatus of claim 2, wherein a. the lower frame has a lower frame upper crossbeam and lower frame lower crossbeam, and b. the set of rod apertures further comprises:

i. a second rod aperture in a lower surface of the upper frame upper crossbeam, ii. a third rod aperture in an upper surface of the upper frame lower crossbeam, iii. a fourth aperture in a lower surface of the upper frame lower crossbeam, iv. a fifth aperture in an upper surface of the lower frame upper crossbeam, v. a sixth aperture in a lower surface of the lower frame upper crossbeam, and vi. a seventh aperture in an upper surface of the lower frame lower crossbeam.

4. The bed exercise apparatus of claim 3, wherein the apertures of the set of rod apertures are irregularly shaped and the rod has one or more protrusions such that the rod movement through the apertures is limited when the one or more rod protrusions are not aligned with the irregular shape of the rod apertures.

5. A bed exercise apparatus for a bed with a bed frame, and a headboard positioned by a head of the bed frame, the bed exercise apparatus comprising:

a. a lower frame disposed between the head of the bed frame and the headboard; and b. an upper frame with exercise equipment mounting connections, the upper frame configured to connect to the lower frame in such manner that all or a portion of the upper frame may be disposed above a top surface of the lower frame, wherein the upper frame and the lower frame are configured in a rectangular annular shape formed of hollow tubing having a rectangular cross-sectional form.

6. The bed exercise apparatus of claim 2, wherein the rod has a mounting ring.

7. The bed exercise apparatus of claim 2, further comprising:

a. a top sheave mounted proximal to a top of the rod;

b. a bottom sheave mounted on the rod below the top sheave; and c. an exercise band, wherein the rod has a mounting ring along a side of the rod, the exercise band has a first end connected to the mounting ring on the rod, the exercise band extending from the first end over a top of the sheave then extending to the bottom sheave, and then under the bottom sheave and extending over the head of the bed frame.

8. A bed exercise apparatus for a bed with a bed frame, and a headboard positioned by a head of the bed frame, the bed exercise apparatus comprising:

a. a lower frame disposed between the head of the bed frame and the headboard;

b. an upper frame with exercise equipment mounting connections, the upper frame configured to connect to the lower frame in such manner that all or a portion of the upper frame may be disposed above a top surface of the lower frame; and c. a lower frame mounting ring connected to the lower frame.

9. The bed exercise apparatus of claim 8, wherein the lower frame mounting ring is connected to a lower surface of a lower crossbeam of the lower frame.

10. A bed exercise apparatus for a bed with a bed frame, and a headboard positioned by a head of the bed frame, the bed exercise apparatus comprising:

a. a lower frame disposed between the head of the bed frame and the headboard;

b. an upper frame with exercise equipment mounting connections, the upper frame configured to connect to the lower frame in such manner that all or a portion of the upper frame may be disposed above a top surface of the lower frame;

c. a mounting elbow connected to a lower surface of a lower crossbeam of the upper frame proximal to a first narrow side of the upper frame; and d. a mounting bracket connected to a second narrow side of the upper frame, wherein i. a mounting aperture is provided proximal to a first narrow side on an upper surface of an upper crossbeam of the lower frame, and ii. the mounting elbow, the upper frame, and the lower frame are configured such that the upper frame may be mounted on the lower frame by first positioning the lower surface of the lower crossbeam of the upper frame perpendicular to the upper surface of the upper crossbeam of the lower frame, inserting the mounting elbow into the mounting aperture, then rotating the upper frame so as to bring the lower surface of the lower crossbeam of the upper frame into flush contact with the upper surface of the upper crossbeam of the lower frame, and then anchoring the mounting bracket to a second narrow side of the lower frame.

11. The bed exercise apparatus of claim 10, further comprising a padding material layer on the upper surface of the upper crossbeam of the lower frame.

12. The bed exercise apparatus of claim 1, further comprising an exercise band connected to at least one of the one or more mounting bars.

13. The bed exercise apparatus of claim 6, further comprising an exercise band connected to at least the mounting ring on the rod.

14. The bed exercise apparatus of claim 8, further comprising an exercise band connected to the lower frame mounting ring, the exercise band extending to a distal end of the bed frame.

15. The bed exercise apparatus of claim 8, further comprising:

a. an exercise band connected to the lower frame mounting ring;

b. a side pole mounted along a side of the bed frame other than the head of the bed frame;

c. a lower sheave mounted on the side pole proximal to a lower end of the side pole; and d. an upper sheave mounted on the side pole proximal to an upper end of the side pole, the exercise band extending first through the lower sheave, and then through the upper sheave.

16. A bed exercise apparatus for a bed with a bed frame, and a headboard positioned by a head of the bed frame, the bed exercise apparatus comprising:

a. a lower frame disposed between the head of the bed frame and the headboard;

b. an upper frame with exercise equipment mounting connections, the upper frame configured to connect to the lower frame in such manner that all or a portion of the upper frame may be disposed above a top surface of the lower frame;

c. a lower section ring mounted on the upper frame proximate to an upper surface of a lower crossbeam of the upper frame;

d. a lower sheave mounted on the upper frame proximate to an upper surface of a lower crossbeam of the upper frame;

e. an upper sheave on an upper surface of an upper crossbeam of the upper frame; and f. an exercise band mounted at a first end on the lower section ring, then extending around the lower sheave and then around the upper sheave, a first aperture in the upper crossbeam of the upper frame allowing the exercise band to extend therethrough between the lower sheave and the upper sheave.

17. The bed exercise apparatus of claim 16, wherein the upper frame has a bisecting crossbeam that bisects the upper frame into an upper portion and lower portion with one or more mounting bars extending from the upper crossbeam of the upper frame to the bisecting crossbeam, and the bisecting crossbeam having a second aperture allowing the exercise band to extend therethrough between the lower sheave and the upper sheave.

18. A bed exercise apparatus for a bed with a bed frame, and a headboard positioned by a head of the bed frame, the bed exercise apparatus comprising:

a. a lower frame disposed between the head of the bed frame and the headboard;

b. an upper frame with exercise equipment mounting connections, the upper frame configured to connect to the lower frame in such manner that all or a portion of the upper frame may be disposed above a top surface of the lower frame; and c. mounting rings mounted on an upper surface of the upper frame.

19. A bed exercise apparatus for a bed with a bed frame, and a headboard positioned by a head of the bed frame, the bed exercise apparatus comprising:

a. a lower frame disposed between the head of the bed frame and the headboard;

b. an upper frame with exercise equipment mounting connections, the upper frame configured to connect to the lower frame in such manner that all or a portion of the upper frame may be disposed above a top surface of the lower frame;

c. a hinge mounted on an upper surface of the upper frame;

d. a rod rotatably mounted to the hinge at a first rod end; and e. mounting rings mounted on a second rod end.

20. A bed exercise apparatus for a bed with a bed frame, and a headboard positioned by a head of the bed frame, the bed exercise apparatus comprising:

a. a lower frame disposed between the head of the bed frame and the headboard;

b. an upper frame with exercise equipment mounting connections, the upper frame configured to connect to the lower frame in such manner that all or a portion of the upper frame may be disposed above a too surface of the lower frame; and c. slide tracks, wherein i. the lower frame is comprised of a lower beam, a first side beam, and a second side beam, the first and second side beams on opposing narrow sides of the lower beam forming an open upper side and the first and second side beams each having inner sides facing each other, ii. the slide tracks extend along the inner sides of the first and second side beams each forming a restricted guide way, and iii. the upper frame is slidably positioned in the slide tracks so that the upper frame may slide along the restricted guide ways and through the open upper side of the lower frame and stay fixedly positioned at one or more positions.

21. The bed exercise apparatus of claim 20, further comprising:

a. a first upper sprocket positioned proximal to an upper end of a first slide track of the slide tracks;

b. a first lower sprocket positioned proximal to a lower end of the first slide track;

c. a first roller chain that at least partially traverses the first slide track and is movably mounted on the first upper sprocket and first lower sprocket, the upper frame having teeth that mesh with the first roller chain so that the upper frame may move up and down as the roller chain rides on the first upper sprocket and the first lower sprocket; and d. a control system connected to the first upper sprocket, the first lower sprocket or both the first upper sprocket and the first lower sprocket that drives or controls the movement of the sprockets.

22. The bed exercise apparatus of claim 21, further comprising:

a. a second upper sprocket positioned proximal to an upper end of a second slide track of the slide tracks;

b. a second lower sprocket positioned proximal to a lower end of the second slide track; and c. a second roller chain that at least partially traverses the second slide track and is movably mounted on the second upper sprocket and second lower sprocket.

23. The bed exercise apparatus of claim 20, further comprising:

a. detents provided on the upper frame that may assume a first extended position and a second retracted position; and b. detent controls connected to the spring biased detents, wherein i. the two slide tracks or the first and second side beams have latching notches, the spring biased detents positioned and configured so as to extend into the latching notches to lock the upper frame into one of the one or more positions.

24. A bed exercise apparatus for a bed with a bed frame, and a headboard positioned by a head of the bed frame, the bed exercise apparatus comprising:

a. a lower frame disposed between the head of the bed frame and the headboard; and b. an upper frame with exercise equipment mounting connections, the upper frame configured to connect to the lower frame in such manner that all or a portion of the upper frame may be disposed above a top surface of the lower frame, wherein i. the lower frame is comprised of a lower beam, a first side beam and a second side beam, the first and second side beams on opposing narrow sides of the lower beam, ii. the first side beam and second side beam are configured as telescoping beams with nested beam portions that can extend and retract, and iii. the upper frame is mounted on the side beams in such manner that the upper frame may alternatively be raised or lowered when the first side beam and second side beam extend or retract.

25. A bed exercise apparatus, comprising:

a. a bed frame;

b. a headboard;

c. a lower frame disposed between and connected to the bed frame and headboard; and d. an upper frame with exercise equipment mounting connections, the upper frame connected to the lower frame, wherein the bed frame and lower frame are one integral piece.

26. A bed exercise apparatus, comprising:

a. a bed frame;

b. a headboard;

c. a lower frame disposed between and connected to the bed frame and headboard;

d. an upper frame with exercise equipment mounting connections, the upper frame connected to the lower frame; and e. a mattress extender provided proximal to a distal end of the bed frame.

27. A bed exercise apparatus, comprising:

a. a bed frame;

b. a headboard;

c. a lower frame disposed between and connected to the bed frame and headboard; and d. a rod with exercise equipment attachment couplers, wherein the lower frame has a lower frame upper crossbeam and a lower frame lower crossbeam and a set of rod apertures comprised of a first rod aperture in a top surface of the lower frame upper crossbeam, the rod extending through the set of rod apertures.

* * * * *